United States Patent [19]

Ohkubo et al.

[11] 4,451,007

[45] May 29, 1984

[54] YARN WINDING APPARATUS

[75] Inventors: Tadahiko Ohkubo; Tetsuhiko Endo; Akiwo Andoh, all of Ohtsu, Japan

[73] Assignee: Toray Industries, Inc., Tokyo, Japan

[21] Appl. No.: 534,404

[22] Filed: Sep. 23, 1983

Related U.S. Application Data

[63] Continuation of Ser. No. 339,003, Jan. 12, 1982, abandoned.

[30] Foreign Application Priority Data

Jan. 16, 1981 [JP] Japan ..... 56-3730

[51] Int. Cl.[3] ..... B65H 54/02; B65H 67/04

[52] U.S. Cl. ..... 242/18 R; 242/18 A; 242/18 PW; 242/18 DD; 242/35.5 A

[58] Field of Search ..... 242/18 R, 18 PW, 18 A, 242/18 DD, 25 A, 35.5 A

[56] References Cited

U.S. PATENT DOCUMENTS

| | | | |
|---|---|---|---|
| 3,561,688 | 2/1971 | Hagihara et al. | 242/18 A |
| 3,682,403 | 8/1972 | Willis | 242/18 A |
| 3,814,338 | 6/1974 | Schippers | 242/18 PW |
| 3,940,077 | 2/1976 | Ohashi | 242/35.5 A |
| 4,103,833 | 8/1978 | Hasegawa et al. | 242/18 A |
| 4,166,586 | 9/1979 | Shirasuna et al. | 242/18 PW |
| 4,324,368 | 4/1982 | Inouye et al. | 242/18 PW |

FOREIGN PATENT DOCUMENTS

| | | |
|---|---|---|
| 0003386 | 8/1979 | European Pat. Off. . |
| 52-38146 | 9/1977 | Japan . |
| 2044308 | 10/1980 | United Kingdom . |

*Primary Examiner*—Stanley N. Gilreath
*Attorney, Agent, or Firm*—Armstrong, Nikaido, Marmelstein & Kubovcik

[57] ABSTRACT

A yarn winding apparatus comprises a rotating drum having a winding part rotatable at a predetermined peripheral speed for winding yarn around a peripheral surface thereof, a transferring part for successively transferring the yarn as wound around the winding part, and a storage part for storing the yarn as fed by the transferring part, the winding, transferring and storage portions being disposed adjacent to one another in the order named, a toothed wheel for catching the continuously supplied yarn around the rotating drum, and a yarn guide for guiding the continuously supplied yarn onto the winding part of the rotating drum. The yarn layers as wound on the winding part are to be discharged successively to the storage part through the transfer part so that the yarn winding speed can be kept always substantially equal to the peripheral speed of the winding part.

23 Claims, 45 Drawing Figures

YARN WINDING APPARATUS

This application is a continuation, of application Ser. No. 339,003, filed Jan. 12, 1982, now abandoned.

BACKGROUND OF THE INVENTION

1. Field of the Invention

The present invention relates to a yarn winding apparatus for winding yarn at a substantially constant speed, and more particularly to such a yarn winding apparatus having no yarn traversing mechanism.

2. Description of the Prior Art

Various means have heretofore been known for taking out a continuous yarn from a yarn supply source at a substantially constant speed. These means are, for example, required to transport a yarn in a measuring device of yarn characteristics, such as coefficient of friction of yarn or dying property of yarn, or to take-up a yarn which continuously runs from a yarn supply source during bobbin changing in a yarn take-up machine. One such known means for taking out from a yarn supply source includes a rotating roller on which the yarn is wound one or few turns before it leaves from the rotating roller. Another yarn taking out means comprises a pair of nipping rollers sandwitching therebetween yarn while they are rotating to feed the yarn. Since these yarn taking out means or feeding means include no means for positively withdrawing yarn from the roller or rollers, there is required a means for taking up the yarn, such as a yarn ejector (a suction gun) or a yarn winding device.

Another means for taking out a yarn from a yarn supply source at a substantially constant speed comprises a yarn winding apparatus for winding the yarn around a rotating bobbin. In this means, for winding up the yarn at a substantially constant speed, it is necessary to provide means for reducing a rotational speed of the bobbin where the bobbin is positively driven or means for leaving the bobbin from a drive roller where the bobbin is driven by a surface contact to the drive roller, since a yarn layer formed on the bobbin becomes thick as the yarn is continuously wound on the bobbin.

SUMMARY OF THE INVENTION

It is an object of the present invention to provide a yarn winding apparatus which will eliminate the foregoing prior difficulties and can wind yarn at a substantially constant speed.

Another object of the present invention is to provide a yarn winding apparatus which can be used as a drive means for feeding yarn at a substantially constant speed.

The above objects can be achieved by providing an apparatus for winding continuously supplied yarn at a substantially constant speed, the apparatus comprising: a rotating drum having a winding part rotatable at a predetermined peripheral speed for winding the yarn around a peripheral surface thereof, a transferring part for successively transferring the yarn wound around the winding portion, and a storage part for storing the yarn fed by the transferring port, the winding, transferring and storage parts being disposed adjacent to one another in the order named; a toothed wheel for winding the continuously supplied yarn around the rotating drum; and a yarn guide for guiding the continuously supplied yarn onto the winding part of the rotating drum. The toothed wheel is mounted coaxially with the rotating drum on an end of the latter which is remote from the storage part of the rotating drum. The yarn guide is positioned upstream of the rotating drum with respect to the direction of supply of the yarn.

The above and other objects, features and advantages of the present invention will become more apparent from the following description when taken in conjunction with the accompanying drawings in which certain preferred embodiments are shown by way of illustrative example.

BRIEF DESCRIPTION OF THE DRAWINGS

FIGS. 14(*a*) through 14(*f*) and FIGS. 15(*a*) through 15(*f*) are views illustrative of the way in which yarn conveying mechanism operates;

DESCRIPTION OF THE PREFERRED EMBODIMENTS

Figure 1:
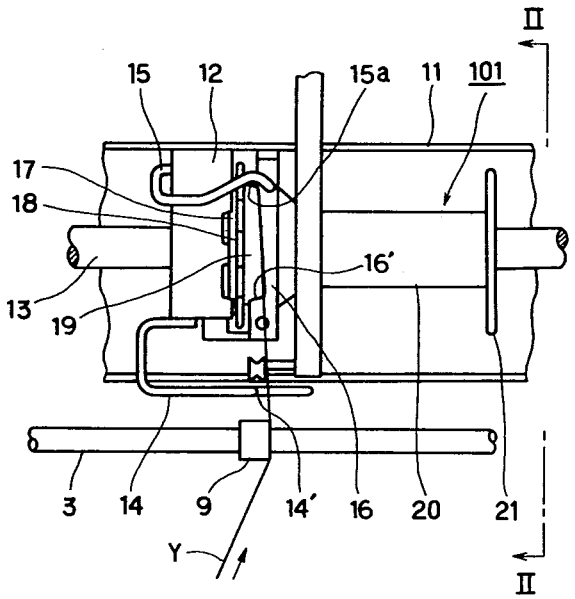
FIG. 1 is a partial plan view of an apparatus according to a first embodiment of the present invention.
Figure 2:
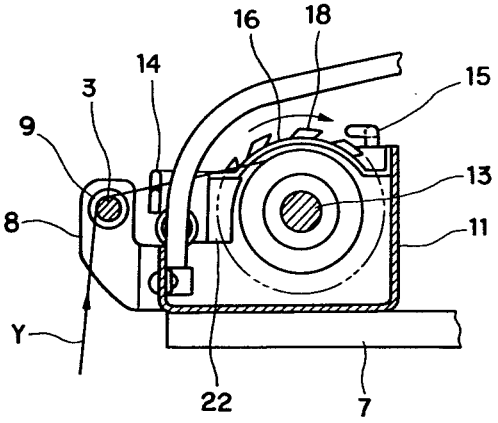
FIG. 2 is a cross-sectional view taken along line II—II of FIG. 1.

As shown in FIGS. 1 and 2, a rotating shaft 13 is rotatably journalled in a bearing 12 fixedly mounted on a front beam 11 and supports thereon an auxiliary winding portion 17, a toothed wheel 18 and a rotating drum 101 fixed in position and disposed adjacent to one another. The rotating drum 101 comprises a drum-shaped winding part 19, a conical transferring part 19*a* (FIG. 3) adjacent to the winding part 19, a drum-shaped storage part 20 adjacent to the conical transferring part 19*a*, and a flange 21 attached to an axial end of the storage part 20 remotely from the conical transferring part 19*a*, the winding part 19, the parts 19*a*, 20 and the flange 21 being arranged in the order named. The rotating shaft 13 is drivable for positive rotation by a driving mechanism (not shown), such as an electric motor.

The front beam 11 also supports a thread transfer collar 9 disposed upstream of the rotating drum 101 with respect to the direction of supply of yarn and movable in a direction parallel to the rotating shaft 13. The thread transfer collar 9 serves to enable yarn supplied from a source of yarn supply (not shown) to be caught by the toothed wheel 18 mounted in coaxial relation to the rotating drum 101 and also to guide the yarn engaged by the toothed wheel 18 to travel onto the winding part 19 of the rotating drum 101. The thread transfer collar 9 is secured to a slide bar 3 axially movably mounted on a bar support 8 which is fixed to a lower arm 7 on which the front beam 11 is disposed.

Between the winding part 19 of the rotating drum 101 and the collar 9, there is a guide 16 positioned closely to the winding part 19 so as to prevent changing of a position at which yarn Y is wound around the winding part 19. The guide 16 has a portion with which the yarn Y is held in contact, such portion being preferably positioned in a plane extending through the yarn winding point on the winding part 19 perpendicularly to the rotating shaft 13. The guide 16 may be omitted by positioning the collar 9 adjacent to the winding part 19 at an adequate point.

A wedge-shaped eliminator 22 is disposed facing to the winding part 19. The eliminator 22 is pointed in a direction opposite to the direction of rotation of the rotating drum 101, and has a side face 22*a* facing in parallel relation to the toothed wheel 18 and a side face 22*b* facing toward the storage part 20 and inclined with respect to the side face 22*a* at an angle $\theta_1$ ranging from 2° to 10°.

The eliminator 22 is fixed to the bearing 12 and disposed closely to the peripheral surface of the winding part 19 with a clearance of 0.05 mm, for example, therebetween. The guide 16 has one end fastened to an upper end of the eliminator 22 and the other end fastened to the front beam 11. The guide 16 has in its surface a yarn introducing portion 16′ in the form of a recess which serves as a yarn guide surface.

When the rotating shaft 13 rotates and the yarn Y is caught through the collar 9 by the toothed wheel 18, the yarn Y starts being wound around the rotating drum 101, whereupon the yarn Y is shifted into the plane extending normally to the rotating shaft 13 and through the point at which the yarn is held against the guide 16, and is wound onto the winding part 19 of the rotating drum 101 at a speed equal to the peripheral speed of the winding part 19. The yarn Y is to be wound in successive layers. As the layers of the yarn Y grow, the outermost layer is continuously transferred by the inclined side face 22*b* of the eliminator 22 toward the storage part 20. Thus, the subsequent yarn Y is wound around the winding part 19 always on a thin layer of yarn previously wound, so that the yarn Y is wound around the rotating drum at a substantially constant speed. When the operation of drawing the yarn from a yarn supply is finished, the yarn Y collected on the storage part 20 is removed as a waste.

Figure 4:
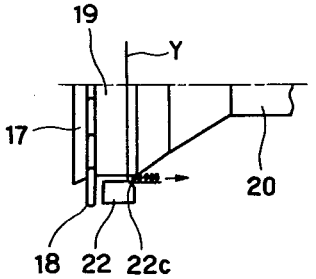
FIG. 4 is a partial plan view of the winding part and the eliminator shown in FIG. 3.

As shown in FIG. 4, the eliminator 22 has on an edge thereof a small slanted corner 22*c* to facilitate discharging the yarn Y off the winding part 19.

Figure 5:
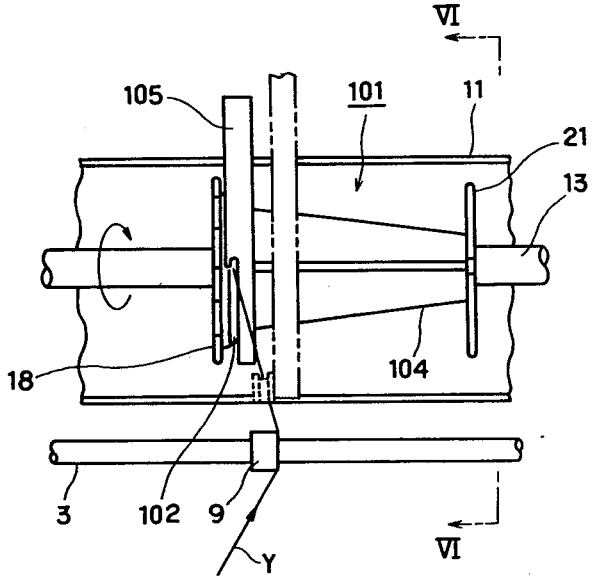
FIG. 5 is a partial plan view of an apparatus according to a second embodiment of the present invention.
Figure 6:
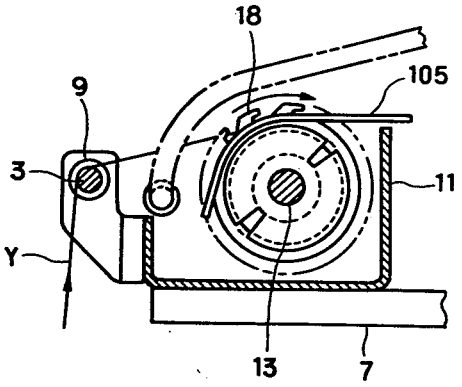
FIG. 6 is a cross-sectional view taken along line VI—VI of FIG. 5.
Figure 7:
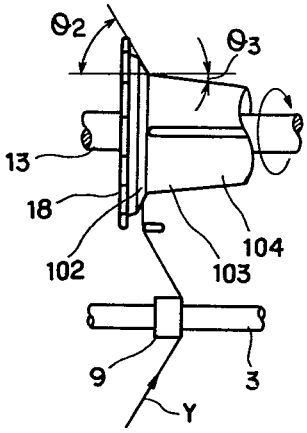
FIG. 7 is a plan view of a winding part in the yarn winding apparatus of FIG. 5.

FIGS. 5, 6 and 7 illustrate an apparatus according to a second embodiment in which no eliminator is employed. A rotating drum 101 mounted on a rotating shaft 13 comprises a conical winding part 102, a conical transferring part 103 adjacent to the winding part 102, and a storage part 104 adjacent to the transferring part 103, the parts 102, 103, 104 being arranged in the order named and fixed on the shaft 13. The rotating shaft 13 is rotatably journalled in a bearing (not shown) mounted on a front beam 11 and is positively driven by a driving mechanism (not shown), such as an electric motor. A toothed wheel 18 is fixed on the shaft 13 in coaxial relation to the rotating drum 101 and disposed remote from the storage part 104. The front beam 11 also supports a thread transfer collar 9 disposed upstream of the rotating drum 101 and movable in a direction parallel to the rotating shaft 13. Yarn as supplied from a source of yarn supply (not shown) is guided by the thread transfer collar 9 so as to be caught by the toothed wheel 18. The thread transfer collar 9 also serves to guide the yarn being wound onto the winding part 102. A fixed guide 105 is located between the winding part 102 and the collar 9 to hold the yarn Y to be wound onto the winding part 102 at a fixed point thereon.

When the shaft 13 is rotated and the yarn Y is transferred by the collar 9 to the toothed wheel 18, the yarn Y starts to be wound around the rotating drum 101. The yarn Y is wound at a speed equal to the peripheral speed of the winding part 102. As the yarn Y is wound in successive layers on the winding part 102, the supplied yarn Y is wound at a higher speed than the outermost layer on the winding part 102. This higher speed causes the yarn tension of outer layers higher than inner layers. As a result, the yarn in inner layers is forced under the pressure of outer yarn layers to be pushed radially inwardly along the conical surface successively onto the storage part 104 across the transferring part 103. As the inner layer yarn is thus removed from the winding part 102, the outer yarn become the smaller in its diameter of convolution and is subjected to less tension, so that the yarn starts to be wound at a normal speed. The yarn repeatedly undergoes the above phenomenon as it is wound in inner and outer layers on the winding part 102. The yarn in inner layers as wound thereon is successively forced to be displaced onto the storage part 104 across the transferring part 103 until the storage part 104 is fully supplied with convolutions of the yarn.

Although in reality the yarn is wound at periodically varying speeds, i.e., high and low speeds of yarn winding are repeated alternately, the difference between such high and low speeds is extremely small and negligible. The yarn Y is thus continuously wound at a substantially constant speed. After the yarn winding has been completed, the yarn Y as wound on the storage part 104 is removed therefrom as a waste. For easy removal of such a waste, the storage part 104 preferably has an axial groove along which a cutter (not shown) can be actuated to discharge the yarn off the storage part 104.

In FIG. 7, the winding part 102 is inclined at an angle of $\theta_2$ with respect to the rotating shaft 13. The angle $\theta_2$ may be selected dependent on the kind of yarn Y to be wound, the tension to be applied to the yarn Y, the thickness of the yarn Y, and the properties thereof. However, the angle is preferably selected in the range of from 15° to 75°. The axis length of the tapered winding part 102 is different dependent on the kind, properties, thickness and other factors of yarn to be wound. With the axial length of the winding part 102 being 10 mm, it can wind thereon yarn of a considerable thickness, such as 2,000 deniers. The transferring part 103 is inclined at an angle of $\theta_3$ with respect to the rotating shaft 13, the angle $\theta_3$ being smaller than the angle $\theta_2$ and preferably in the range of from 0° to 15°. The axial length of the transferring part 103 may be selected as desired.

The drum-shaped and conical storage parts 20, 104 in the apparatus shown in FIGS. 1, 2 and FIGS. 5, 6 are suitable for use with shrinkable yarn such as twisted yarn or spuntex yarn. When non-shrinkable yarn is wound around these storage part 20, 104, there is a danger of the yarn to swinging off the storage part while the storage parts are in operation.

Figure 8:
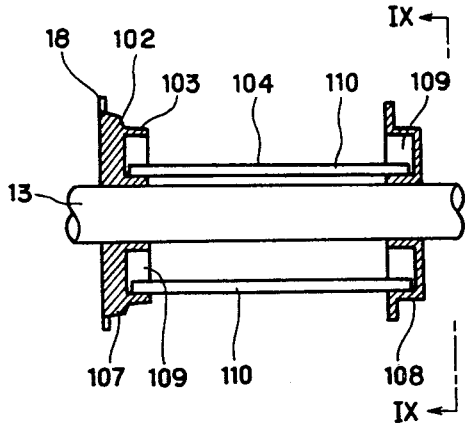
FIG. 8 is a cross-sectional view of an apparatus according to a third embodiment of the present invention.
Figure 9:
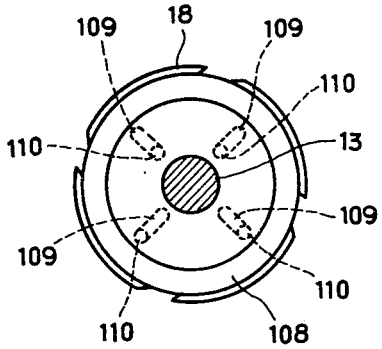
FIG. 9 is a cross-sectional view taken along line IX—IX of FIG. 8.

According to still another embodiment shown in FIGS. 8 and 9, a storage part 104 includes a pair of flanges 107, 108 secured to a shaft 13 and having therein radial slots 109 with closed ends. The radial slots 109 in the flanges 107, 108 are provided in three pairs or more, preferably in four to ten pairs. A rod 110 is fitted at its ends in each pair of the slots 109, and movable radially of the flanges 107, 108 but prevented from dropping easily off the slots 109. When the shaft 13 rotates, the rods 110 are urged under centrifugal forces into engagement with radially outward ends of the slots 109, whereupon yarn as fed from a transferring part 103 is wound and collected around the rods 110 as thus displaced radially outwardly. The flanges 107, 108 have an outside diameter well larger than the lengths of the diametrically opposite slots 109, so that a large amount of yarn can be stored around the storage part 104. The storage part 104 thus constructed is best suited for carrying yarn of less shrinkability. As better shown in FIG. 8, one of the flanges 107 has winding and transferring parts 102, 103 and a toothed wheel 18 is mounted thereon.

The apparatus of the present invention thus can wind yarn onto the peripheral surface of a rotating drum at a substantially constant speed without using a mechanism to reducing a rotational speed of the drum. This can be achieved by continuously removing yarn convolutions from the winding part with the eliminator, or by forcing previous yarn convolutions to be pushed radially inwardly along the conical winding part under fastening forces due to the tension of following yarn convolutions newly wound on the previous yarn convolutions, so that the yarn can be progressively wound and collected on the storage part 104 without allowing a substantial yarn convolution buildup on the winding part. The winding part is constructed such that the yarn can smoothly drop off radially inwardly, but can reliably be wound up on the winding part without slipping in the circumferential direction in the plane extending perpendicularly to the rotating shaft and in which the yarn is continuously wound.

With the apparatus of the first embodiment, the angle $\theta_1$ of the eliminator and the clearance between the eliminator and the winding part should be selected to suit the kind, nature, thickness and other characteristics of the yarn to be wound, and with the arrangements according to the second and third embodiments, the angle $\theta_2$ of inclination of the winding part, the surface roughness, material and other properties of the winding part should be selected to match the yarn to be handled. The winding part may be provided with axial slots so as to be able to wind thereon slippery yarn or yarn under high tension. While in the illustrated embodiments the apparatus are operated by positively driving the rotating shaft 13 with the source of drive coupled thereto, other driving arrangements can be employed which may comprise a positively driven drum brought into contact with the flange 21 shown in FIG. 1 or the flange illustrated in FIG. 8.

The apparatus thus assembled will find a variety of applications. For example, the apparatus may be incorporated in textile measuring instruments which require simultaneous feeding of yarn at a constant speed and winding of the yarn thus fed, as when measuring the yarn tension as it is unwound from the yarn package, or measuring the coefficient of friction (dynamic frictional coefficient) of yarn while running with other objects, and continuously measuring the degree to which yarn is dyed, and yarn irregularities. Since the apparatus of the invention can double as a mechanism for driving yarn at a substantially constant speed and a mechanism for winding the yarn as thus withdrawn, the overall arrangement is simple in construction and can be handled with ease. The apparatus of the invention can also be used as a waste spool associated with a yarn take-up machine serving as production equipment for winding yarn as continuously fed from a known yarn processing stage.

Figure 10:
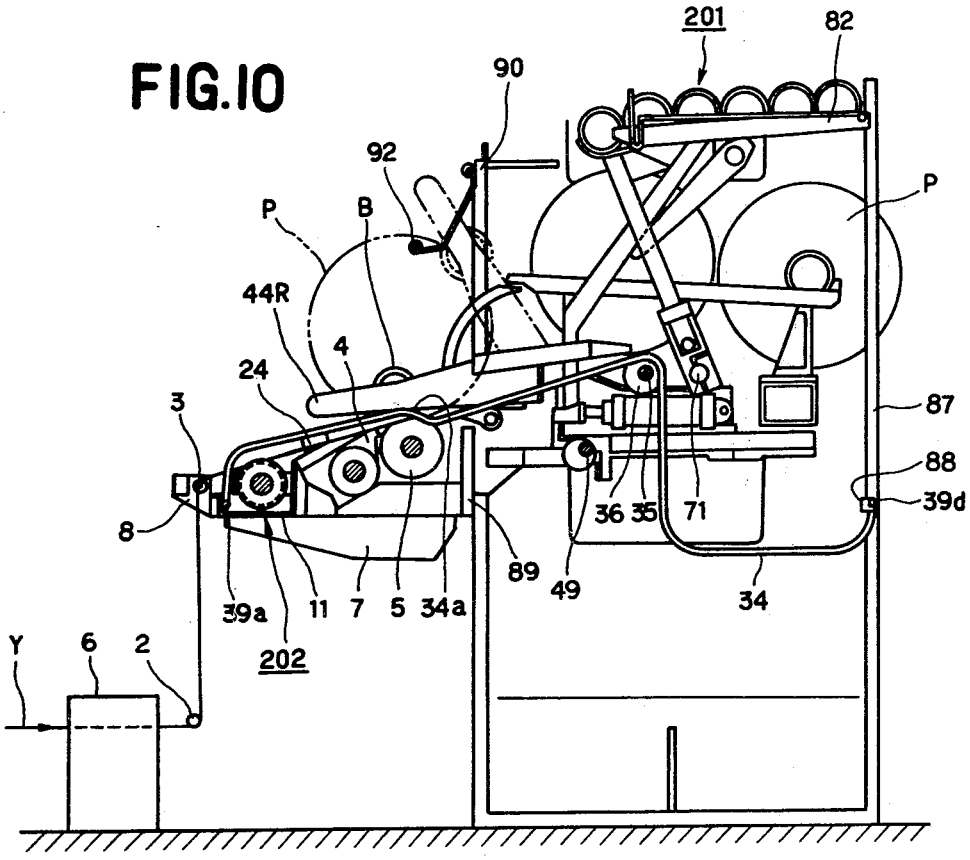
FIG. 10 is a side view of a yarn take-up machine in which the apparatus according to the first embodiment is employed as a waste spool of the yarn take-up machine.
Figure 11:
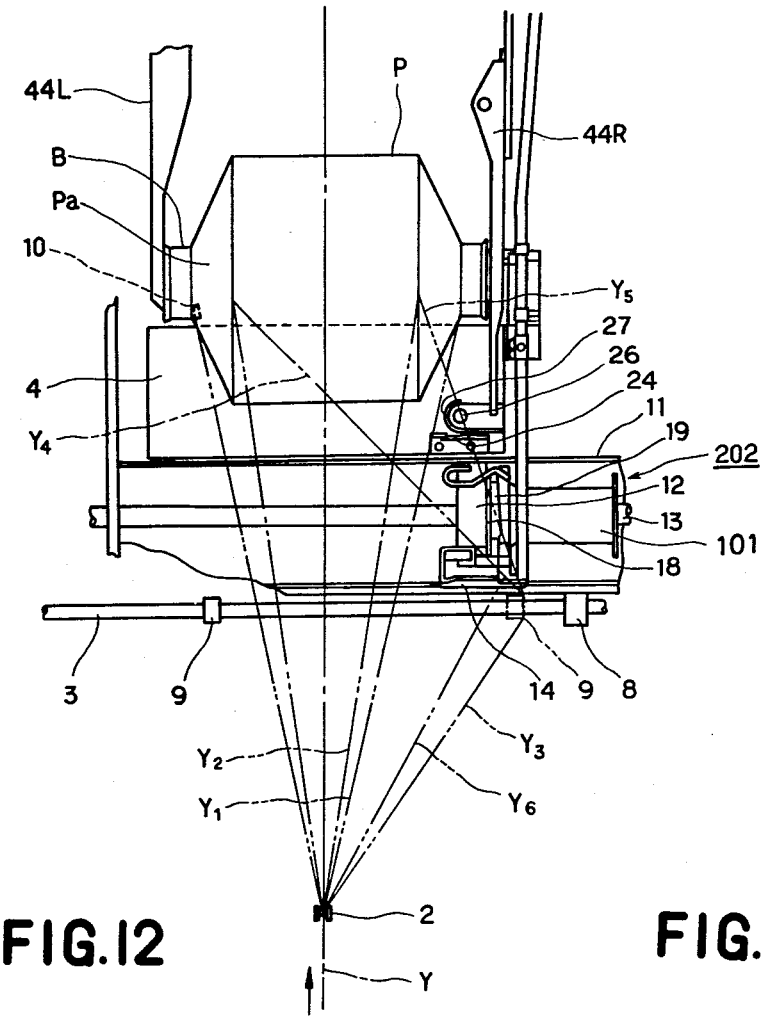
FIG. 11 is a partial view of the yarn winding apparatus of FIG. 10.

FIGS. 10 and 11 shows a yarn take-up machine in which the apparatus shown in FIGS. 1 and 2 is utilized as a waste spool. Designated at 201 is a yarn take-up machine for winding yarn Y onto a package P which is positively and continuously fed from a yarn supply (not shown) at a constant speed. The yarn take-up machine 201 basically comprises a pair of cradle arms 44R, 44L between which a bobbin B is rotatably supported at ends thereof, a traversing device 4 containing a mechanism for traversing yarn axially of the bobbin B, a traverse guide 10 reciprocally movable in the axial direction of the bobbin B by the traversing mechanism for forming layers Pa of yarn on the bobbin B, a drive roller 5 held in contact with the surfaces of the bobbin B and the yarn layers Pa for driving the bobbin B and the package P, and a guide 2 acts as a fulcrum guide for yarn traversing.

The apparatus according to the first embodiment of the invention acts as a waste spool 202 disposed between the guide 2 and the bobbin B mounted on the cradle arms 44R, 44L, the waste spool 202 being positioned slightly off the righthand end of the bobbin B as illustrated in FIG. 11. The rotative shaft 13 for driving the rotating drum 101 extends parallel to an axis of the bobbin B which is supported on the cradles. A slide bar 3 having a thread transfer collar 9 is mounted on a bar support 8 and extends parallel to the rotating shaft 13 on a side thereof closer to the guide 2.

Figure 12:
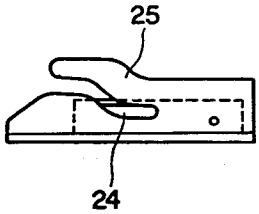
FIG. 12 is a front view of a yarn cutter.
Figure 13:
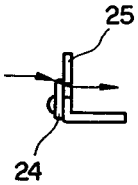
FIG. 13 is a side view of the yarn cutter shown in FIG. 12.

The guide 2 is disposed on an extension line passing centrally across the stroke of the traversing device 4, and may be secured to a step 6 or a front surface of the front beam 11. A yarn shift cutter 24 and a screw guide 26 are fixedly mounted on the top of the traversing mechanism 4 at a position outside a zone which yarn $Y_1$ traverses under normal winding conditions. As illustrated in FIGS. 12 and 13, the yarn shift cutter 24 is fixed by a cutter holder 25 having a slot for guiding yarn Y. The screw guide 26 is positively drivable by a power source, and has on its outer peripheral surface at least one screw groove for guiding the yarn Y. A guard 27 (FIG. 14) is provided in such a position as to both protect the screw guide 26 and define a yarn path in yarn catching operation.

In order for the apparatus of FIGS. 1 and 2 to be used as the waste spool 202, it is necessary that a yarn introduction guide 14 be disposed between the guide 16 and the slide bar 3. The yarn introduction guide 14 has a yarn catch 14' having one end secured to the bearing 12 and the other end extending in front of the winding part 19. The yarn catch 14' extends from the winding part 19 slightly toward the waste storage part 20 in order to serve as a first yarn path when the yarn Y is wound around the winding part 19.

Between the rotating drum 101 and the traversing device 4, there is provided an elbow guide 15 (FIG. 14) having one end secured to the bearing 12 and a bent guide portion 15*a* disposed slightly closer than the yarn catch 14' to the toothed wheel 18 so as to define a second yarn path for the yarn Y being wound around the winding part 19 when the yarn Y is conveyed by a yarn conveying mechanism (described later).

The yarn take-up machine 201 additionally includes a yarn conveying mechanism, a bobbin supporting mechanism, and an empty bobbin supplying mechanism, which will now be described successively.

Yarn Conveying Mechanism

Figure 16:
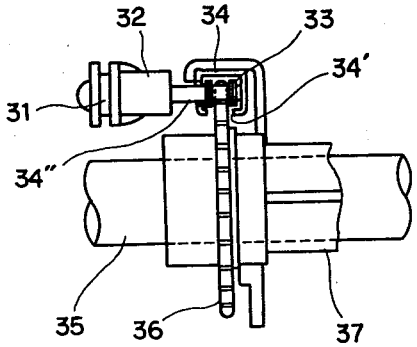
FIG. 16 is a front view of a device for actuating a flexible member.

As shown in FIG. 16, a guide member 31 is attached by a guide holder 32 to a flexible member or roller chain 33, which is loosely inserted in a sheath or rectangular one side opened pipe 34. The rectangular pipe 34, as illustrated in FIG. 10, has one end extending between the yarn introduction guide 14 and the winding part 19 and fixed by a fastener 39*a* to the front beam 11. The rectangular pipe 34 extends over the winding part 19, the traversing device 4, and the drive roller 5 and has a downwardly curved portion 34*a* extending beyond the drive roller 5 and a narrow portion of the cradle arm 44R. The rectangular pipe 34 is bent along an outer periphery of a sprocket 36 attached securely to a drive shaft 35 by a split fastener 37 (FIG. 16), and has the other end fixed by a fastener 39*d* to a rear lower beam 88 (FIG. 10).

The rectangular pipe 34 has slots 34', 34" (FIG. 16) through which the sprocket 36 and the roller chain 33 engage each other, and the guide member 31 is allowed to move, respectively. When the sprocket 36 rotates, the guide member 31 reciprocably moves along the curved rectangular pipe 34 between the yarn introduction guide 14 and a point 34*p* (FIG. 15) located slightly ahead of the curved portion of the pipe 34 around the drive roller 5. The roller chain has one end reciprocally movable in the rectangular pipe 34 between the sprocket 36 and the rear lower beam 88.

Figure 17:
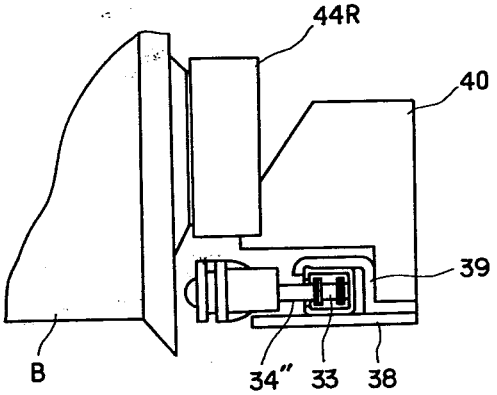
FIG. 17 is a partial front view of a positioning mechanism and a cradle.
Figure 18:
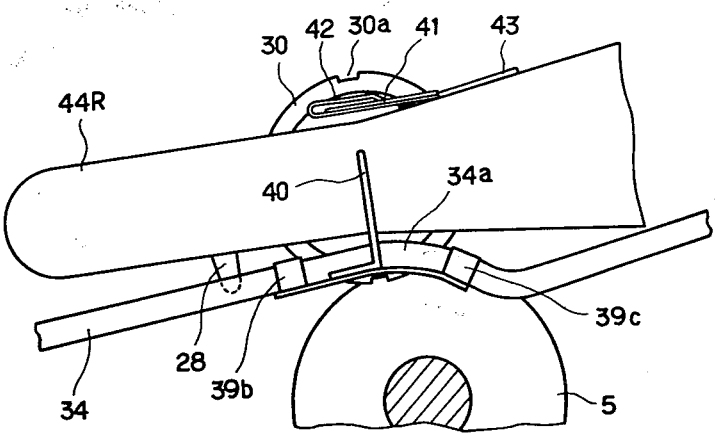
FIG. 18 is a side view of the positioning mechanism and the cradle shown in FIG. 17.

As illustrated in FIGS. 17 and 18, a positioning member 40 is attached through a slider 38 to the curved portion 34*a* of the rectangular pipe 34 by means of fasteners 39*b*, 39*c*. The positioning member 40 is held against lower and side surfaces of a central portion of a bobbin bearing 29R (FIGS. 19 and 20) on the cradle arm 44R. Such a structure allows the cradle arm 44R and the rectangular pipe 34 to be positioned properly with respect to each other for reliable yarn catching operation.

A timing guide 28 for enabling a notched wheel 30 to catch yarn instantaneously is attached to the cradle arm 44R at a position off a free end thereof and is directed downwardly, the timing guide 28 having a distal end located slightly upwardly of the yarn path for yarn catching operation and out of interference with the yarn conveying guide 31.

A cutter 41 for cutting off yarn after the latter has been caught is mounted on the top of the cradle arm 44R by means of a cutter holder 43 and has a folded-over end portion serving as a guide 42. The cutter 41 is disposed between the cutter holder 43 and the guide 42 and out of contact with the bobbin bearing 29R.

Bobbin Supporting Mechanism

Figure 19:
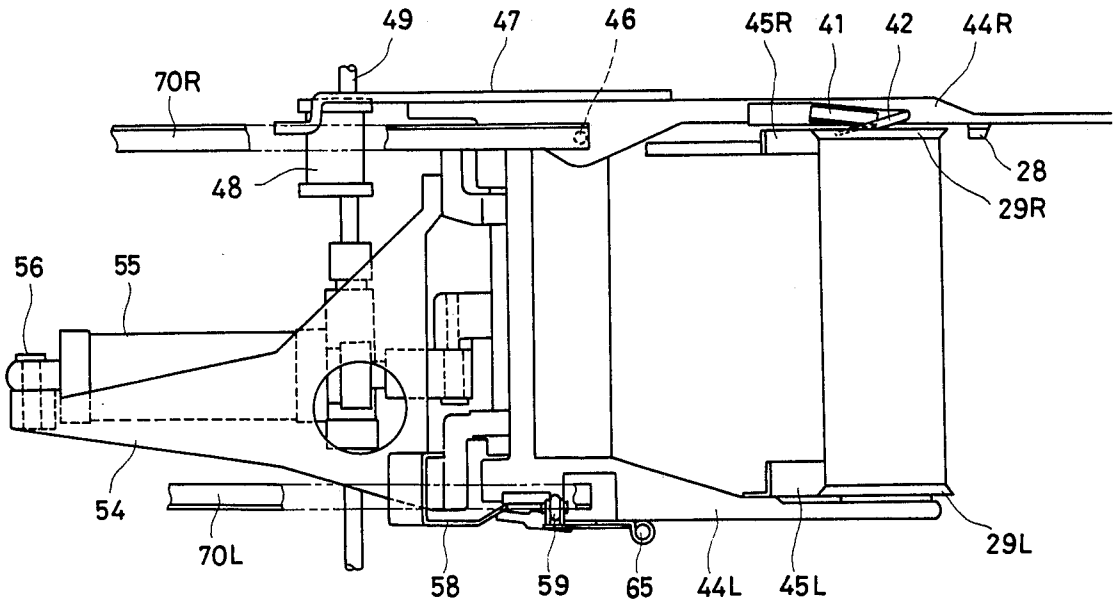
FIG. 19 is a plan view of a bobbin supporting mechanism having a cradle arm as a main element.
Figure 20:
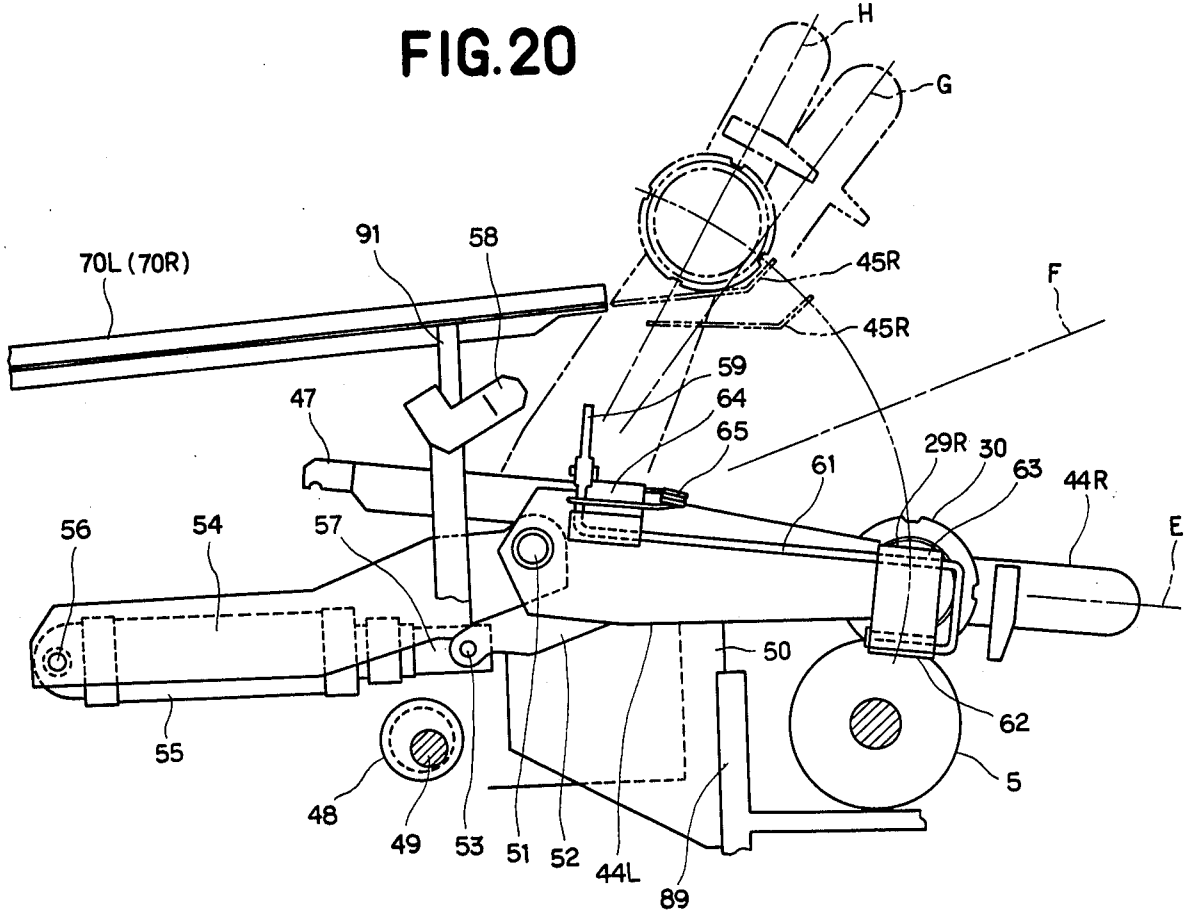
FIG. 20 is a side view of the bobbin supporting mechanism illustrated in FIG. 19.

As illustrated in FIGS. 19 and 20, the bobbin B is supported by rotatable bobbin bearings 29L, 29R between the free end portions of the cradle arms 44L, 44R which extend radially from a pivot shaft 51 in substantially parallel relation to each other. The cradle arms 44L, 44R are angularly movable about the pivot shaft 51 from a winding start position E in which the bobbin B is held in contact with the peripheral surface of the drive roller 5 to a doffing position H.

An actuator cylinder 55 has a movable end coupled through a link pin 53 and a cylinder head 57 to an arm 52 mounted on the pivot shaft 51 and angularly spaced from the cradle arms 44L, 44R. The actuator cylinder 55 has a fixed end coupled by a pin 56 to a bracket 54 secured to a bearing 50 on which the pivot shaft 51 is supported.

The cradle arm 44R is pivotably mounted by a pin 46 (FIG. 19) on the cradle arm 44L so that the cradle arms 44R, 44L can be opened and closed. An extension lever 47 is attached to the cradle arm 44R on a side thereof which is opposite to the side on which the bobbin B is supported. The bobbin bearing 29L, 29R mounted rotatably on the free end portions of the cradle arms 44L, 44R, respectively, share an axis which extends substantially horizontally and parallel to the pivot shaft 51. The bobbin bearings 29L, 29R project toward each other and have outer peripheral surfaces fitted in a bore in the bobbin B with flanges of the bobbin bearings being held against the ends of the bobbin B.

The notched wheel 30 (FIG. 20) is defined by a flange of the bobbin bearing 29R where yarn catching is to be effected, and has at least two notches 30*a* as shown in FIG. 18, the notches 30*a* extending radially inwardly beyond the outer periphery of the bobbin B.

Figure 21:
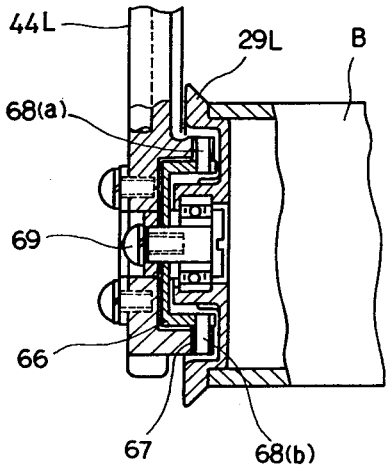
FIG. 21 is a cross-sectional view of a bearing assembly including an intermediate bearing.

The bobbin bearing 29L is pivotably mounted on the cradle arm 44L, as shown in FIG. 21, by an intermediate bearing 66 supported on shafts 68*a*, 68*b* extending perpendicularly to the axis of the bobbin B and substantially parallel to the cradle arm 21. The bobbin bearing 29L is rotatable about its own axis and angularly movable about the shafts 68*a*, 68*b*.

Figure 22:
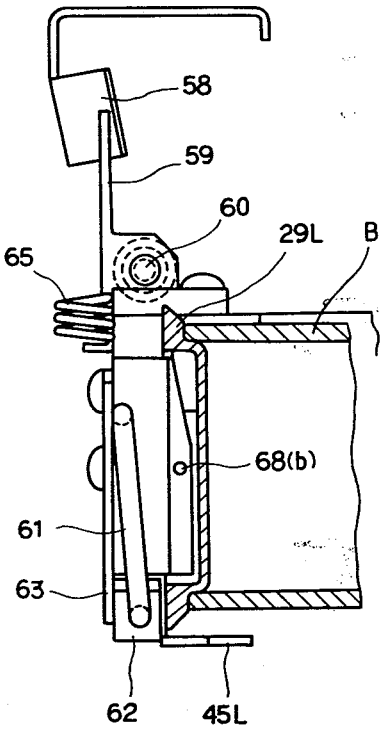
FIGS. 22 and 23 are cross-sectional views showing a bearing supported on the intermediate bearing and a presser member.

As illustrated in FIG. 22, a brake tip 62 is loosely fitted over a crank 61 and placed between a presser plate 63 and the cradle arm 44L. The crank 61 has a central part which extends along the cradle arm 44L toward the pivot shaft 51 as shown in FIG. 20, there being a one-way lever 59 pivotably mounted by a pin 60 (FIG. 22) on the end of the central part of the crank 61. The one-way lever 59 has a lower end urged against the crank 61 by a return spring 65 fixed to a bearing 64.

A brake cam 58 (FIG. 20) is fixed to a front support column 91. As the cradle arms 44R, 44L are angularly moved beyond a fully wound position F, the upper end of the one-way lever 59 is brought into engagement with the brake cam 58, and the one-way lever 59 remains engaging the brake cam 58 until the cradle arms 44R, 44L reach a doffing preparatory position G. When the cradle arms 44R, 44L arrive at a doffing position H, the one-way lever 59 disengages the brake cam 58.

A bobbin support rail 45L (FIG. 22, FIG. 23) is positioned below the bobbin bearing 29L and attached directly to the cradle arm 44L. When in the doffing position H, the bobbin support rail 45L is inclined forward at an angle of from 3° to 5°. An bobbin support rail 45R is positioned below the bobbin bearing 29R on the cradle arm 44R in confronting relation to the bobbin support rail 45L, but is secured to one end of an extension arm extending from the cradle arm 44L. The bobbin support rail 45R is therefore independent of opening and closing operation of the cradle arm 44R.

Figure 24:
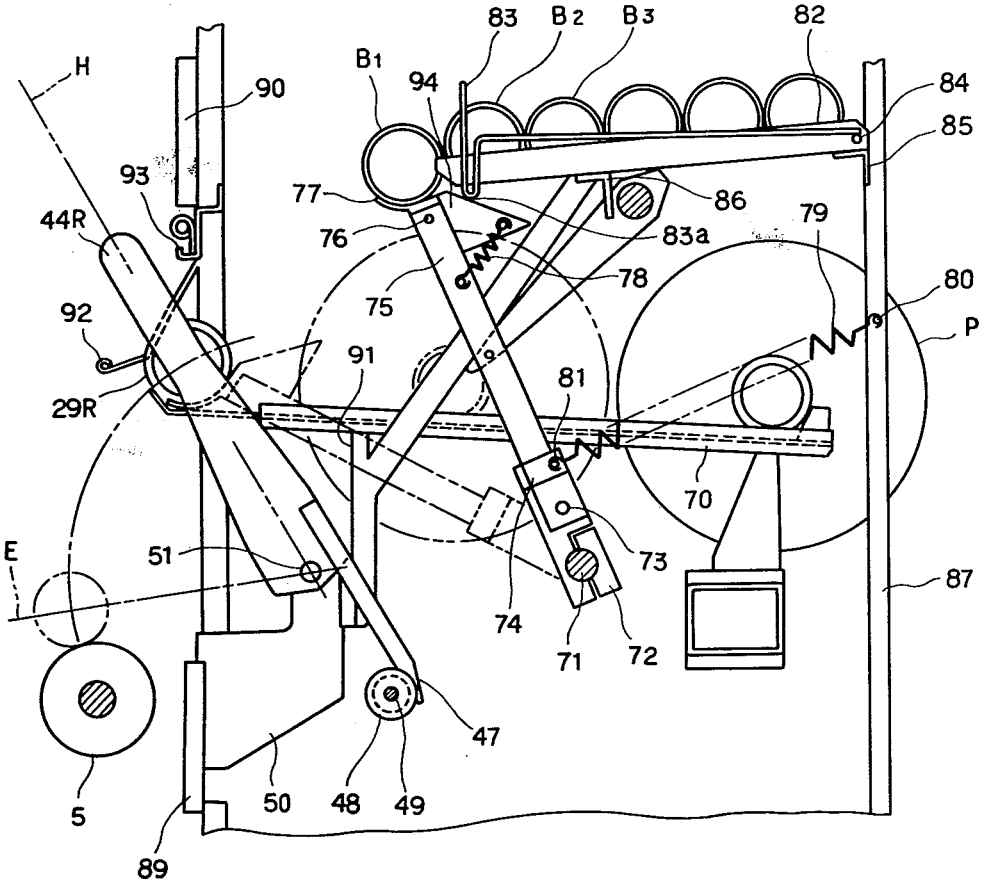
FIG. 24 is a side view of a mechanism for feeding empty bobbins.

As shown in FIGS. 20 and 24, a pair of reserve rails 70L, 70R correspond respectively to the bobbin support rails 45L, 45R and extend rectilinearly in substantially parallel relation to each other, the reverse rails 70L, 70R being of an L-shaped cross section. When the cradle arms 44L, 44R are in the doffing position, the reserve rails 70L, 70R are joined to the bobbin support rails 45L, 45R, respectively. The reverse rails 70L, 70R extend at an angle of from 3° to 6° with respect to the horizon and become progressively lowered toward the rear of the yarn take-up machine 201. The reserve rails 70L, 70R are fixed to front and rear support column 91, 87.

A flanged eccentric cam 48 is eccentrically fixed to a shaft 49 rotatably and axially slidably mounted on a lower end of the bearing 50, the cam 48 having flanges on its both ends. An extension lever 47 attached to the cradle arm 44R has a free end movable into and out of engagement with the flanged eccentric cam 48 between the flanges.

As shown in FIG. 24, a pair of springs 92 which serve as means for engaging fully wound packages are fixed by brackets 93 to a central upper beam 90. The springs 92 have free ends positioned out of a path along which the cradle arms 44 with a bobbin B mounted are angularly moved. When the cradle arms 44L, 44R are in the doffing position, the springs 92 engage an end of the bobbin B. When a pair of feed arms 75 is in feeding operation with a bobbin $B_1$ carried on a bobbin support 77, the springs 92 are kept out of contact with the bobbin $B_1$.

Empty Bobbin Supplying Mechanism

In FIG. 24, the pair of feed arms 75 are disposed astride of the reserve rails 70L, 70R and the front support column 91 and positioned rearward of the cradle arms 44L, 44R. The feed arms 75 are attached radially to a drive shaft 71 extending parallel to the pivot shaft 51 by means of split fasteners 72 and pins 73. The feed arms 75 are prevented by a stop 74 from bending to the left beyond a certain range. The bobbin support 77 is swingably mounted by pins 76 on free ends of the feed arms 75. The feed arms 75 are normally urged by a return spring 78 in a direction to direct the bobbin support 77 upwardly.

A pair of inclined store rails 82 extends substantially parallel to each other for jointly supporting thereon empty bobbins due to their gravity. The storing rails 82 are located upwardly of the feed arms 75 and attached to the front and rear support columns 91, 87 such that the storing rails 82 are higher at the rear of the yarn take-up machine 201 and become progressively lower toward the bobbin support 77 on the feed arms 75. Thus, the storing rails 82 extend at an angle of from 3° to 5° with respect to the horizon.

The storing rails 82 have a rear shaft 84 from which extends a bobbin separation arm 83 toward the lower end of the storing rail 82, the arm 83 having a downwardly curved portion 83*a* held in abutment against a flat cam portion above the bobbin support 77, and also having a distal end bent in overlying relation to the bobbin $B_2$.

The feed arms 75 are movable by the drive shaft 71 from a return position in which the feed arms 75 receive an empty bobbin $B_1$ from the storing rails 82 to a supply position in which the feed arms 75 supply the empty bobbin to the cradle arms 44L, 44R when the latter are spread apart while in a donning position. The feed arms 75 tend to move about the drive shaft 71 downwardly at all times due to gravity irrespective of whether they carry a bobbin or located in the supply or the return position. To cope with this tendency, a counterbalancing spring 79 acts between the split fastener 72 and the rear support column 87 to bias the feed arms 75 in a direction opposite to the direction in which the feed arms 75 tend to move due to gravity.

Figure 25:
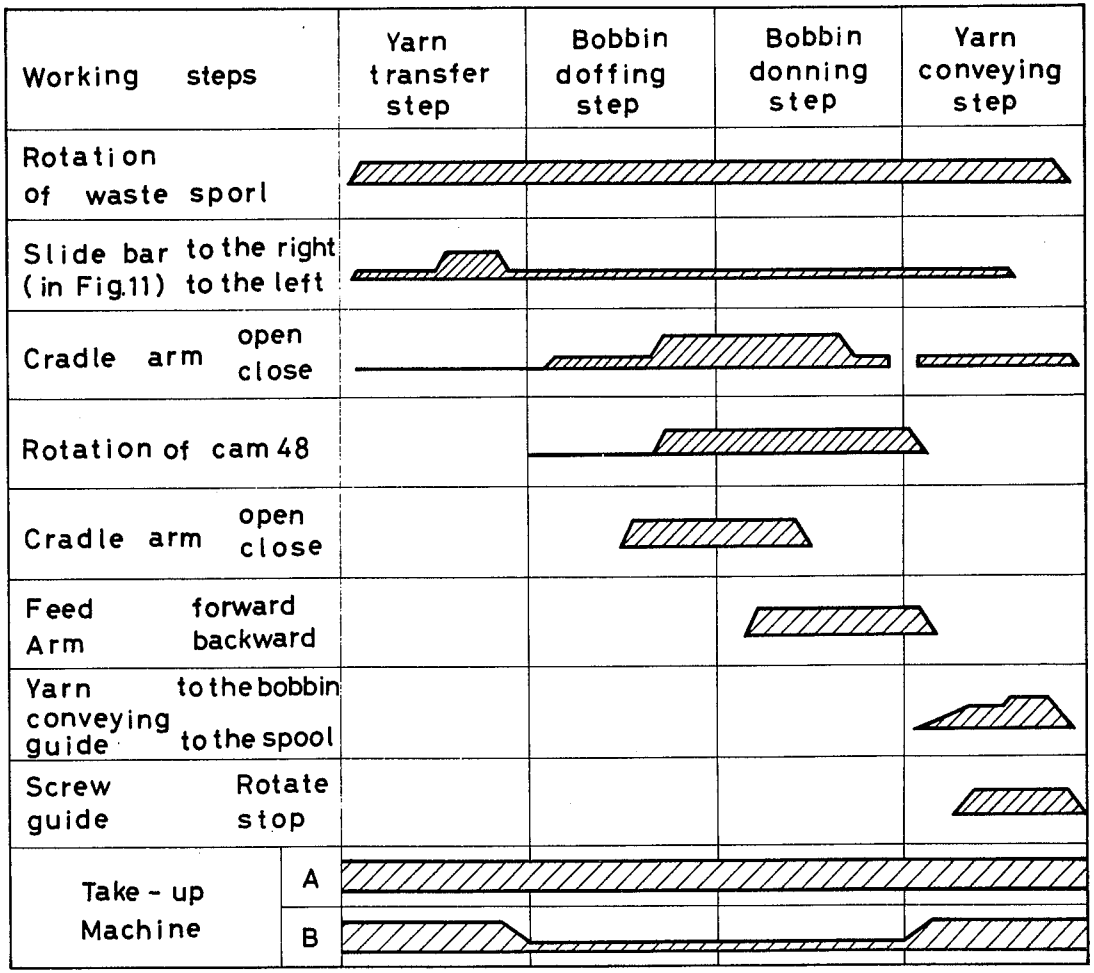
FIG. 25 is a timing diagram showing a sequence control pattern for the yarn winding apparatus.

The yarn take-up machine thus constructed will operate as follows: Operation of the yarn take-up machine is effected in the following four steps as shown in FIG. 25:

1. The step of temporarily shifting yarn as continuously supplied and wound to yarn winding means shown in FIGS. 1–9;
2. The step of stopping rotation of a full package and transferring the same from the cradle arms onto the reserve rails;
3. The step of taking one empty bobbin from the storing rails and installing the bobbin on the cradle arms in preparation for yarn winding; and
4. The step of conveying the yarn which is temporarily wound on the waste spool to the empty bobbin on the cradle arms for yarn winding.

The above four steps show a sequence of operations upon doffing, and will be described in succession.

Yarn Transferring Step

When a certain amount of yarn Y is wound around a bobbin B on the yarn take-up machine 201, a full-bobbin signal (not shown) triggered by accumulation of time or rotation to start yarn shifting.

The full-bobbin signal first causes the waste spool 202 to rotate at a peripheral speed substantially equal to the speed at which the yarn is wound. Then, the slide bar 3 is moved from the solid-line position of FIG. 11 to the right, whereupon yarn $Y_2$ as it is normally traversed while being wound is caused by the thread transfer collar 9 to be displaced toward the waste spool 202. The yarn thus displaced is caught by the toothed wheel 18 adjacent to the waste spool 202 and is severed by the cutter 24 disposed between the package P and the waste spool 202. The yarn which has continuously been supplied onto the package P is now shifted to the waste spool 202.

Such a yarn switching operation in the yarn shifting step will be described in more detail. To enable the yarn to be temporarily wound around the waste spool 202 which is located out of the zone in which the yarn is traversed while being wound under normal conditions, the slide bar 3 starts being displaced while the yarn $Y_2$ is being wound around the package P. As the thread transfer collar 9 is moved to the righthand end, the yarn $Y_2$ being wound is caused to be temporarily fed along a yarn path $Y_3$ and to be traversed within a region between yarn paths $Y_4$, $Y_5$ as shown in FIG. 11. As the yarn is traversed from the yarn path $Y_4$ to the yarn path $Y_5$, the yarn path becomes progressively shorter and hence the yarn is subjected to the smaller tension. When the yarn tension is minimum at a position close to the yarn path $Y_5$, the yarn is caught by the toothed wheel 18.

With the yarn $Y_5$ caught by the toothed wheel 18, the yarn is under increased tension and kept stretched tightly as it is pulled both toward the package P and toward the auxiliary winding portion 17 and the winding part 19 via the toothed wheel 18. At this time, the yarn $Y_5$ as it changes its direction of travel is automatically introduced into the groove in the cutter holder 25 extending at an angle to the cutter 24, and is cut off by the cutter 24 while the yarn is under a relatively low tension. The cutter 24 allows yarn to be severed at a fixed position at all times with the result that the chance of success of yarn shifting is increased.

The downstream end of the yarn $Y_5$ as cut off is wound onto the package P, whereas the upstream end of the yarn $Y_5$ is wound onto the winding part 19 via the auxiliary winding portion 17 and the toothed wheel 18, thus completing the yarn shifting operation.

Figure 3:
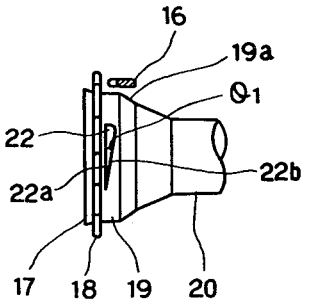
FIG. 3 is a side view showing a winding part and an eliminator.

When the slide bar 3 returns to the left after the yarn transfer to the waste spool is finished, yarn $Y_3$ on the upstream side is caused by the yarn catch 14' on the top of the introduction guide 14 to follow a yarn path $Y_6$, and is wound around the winding part 19 through the guide 16. As described before, the first yarn path along which the yarn is wound onto the winding part 19 through the guide 16 (FIG. 14) is selected in position such that the yarn is wound on a thin yarn layer as excessive yarn layers built up thereon are continuously removed by the eliminator 22 (FIG. 3). The yarn as removed by the eliminator 22 is stored on the waste storage part 20. After the yarn has been transferred onto an empty bobbin, the waste on the waste storage part 20 is taken away.

The yarn shifting step is followed by the doffing, donning, and yarn catching steps. But first, the yarn catching step will be described.

Yarn Catching Step

While the package P is being doffed and the empty bobbin $B_1$ is being donned, the continuously supplied yarn Y is wound around the waste spool 202 via the guide 2, the slide bar 3, the yarn introduction guide 14, and the guide 16.

When the shaft 35 is driven to rotate clockwise as shown in FIG. 10, the flexible roller chain 33 inserted through the rectangular pipe 34 is driven by the sprocket 36 to cause the guide member 31 attached to one end of the roller chain 33 by the guide holder 32 to pick up the yarn $Y_6$ travelling between the yarn introduction guide 14 and the winding position guide 16. Then, the guide member 31 conveys the picked-up yarn $Y_6$ along the curved pipe 34 toward an end face of the bobbin B as installed on the cradle arms 44.

Such a process of conveying the yarn $Y_6$ will be described in more detail with reference to FIGS. 14, 14(*a*) through FIGS. 14(*f*) and FIGS. 15, 15(*a*) through FIGS. 15(*f*). The guide member 31 moves from a starting position J toward the bobbin B and picks up the yarn $Y_6$ at a point K. On excursion to a point L, the yarn $Y_6$ is released from the yarn catch 14' of the yarn introduction guide 14, and hence extends from the slide bar 3 directly to the guide member 31. As the guide member 31 further moves to a point M, the yarn Y is wound thereon at an angle of 90 degrees or larger, the angle becoming progressively larger as the guide member 31 moves on.

The yarn Y as it is wound via the guide member 31 has a downstream portion guided by the guide surface 16*a* on the guide 16, and is wound along a second yarn path directly onto the waste spool 202 from which yarn layers are removed by the eliminator 22. The guide member 31 moves in a direction to reduce the yarn tension gradually. At the same time, the yarn path becomes progressively larger as the guide member 31 continues to move. The waste spool 202 may be driven to rotate at a peripheral speed selected to offset the reduction in the yarn tension by the increase of the yarn path, preventing the yarn from being sagged.

Figure 14:
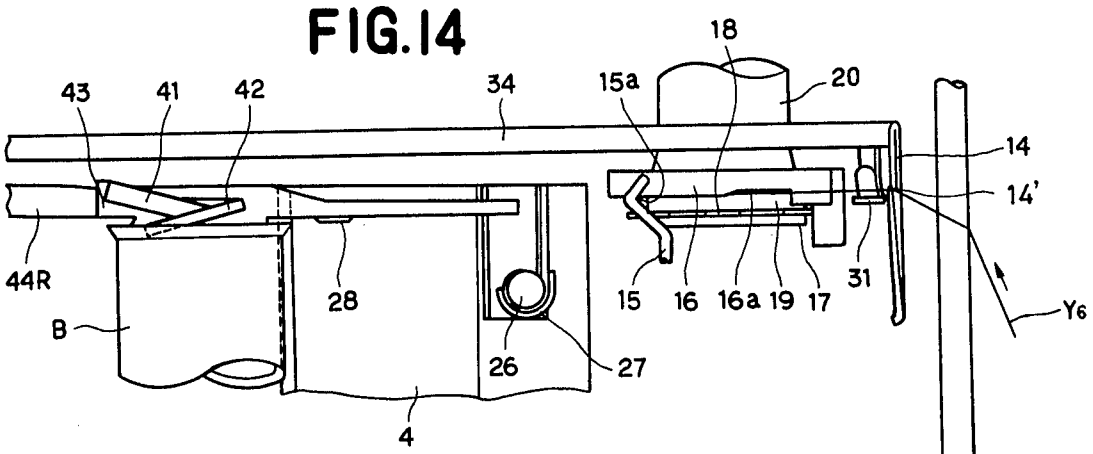
FIG. 14 is a plan view of a yarn conveying mechanism according to a first mechanism.

As the guide member 31 moves on past the timing guide 28 on the cradle arms 44R until it reaches a point N, the yarn passes along a yarn path $Y_7$ as shown in FIGS. 14(*a*) and 15(*a*). More specifically, the yarn extends from the guide 2 through the slide bar 3, the guard 27, the timing guide 28 that serves as a yarn path defining member, to the guide member 31 where the yarn is folded back through 180 degrees, and then the yarn goes through the elbow guide 15 and the winding position guide 16 before the yarn is wound around the waste spool 202. When the guide member 31 reaches the point N, the drive shaft 35 which drives the roller chain 33 is temporarily slowed down or stopped to wait until the yarn being fed is less tensioned.

Figure 15:
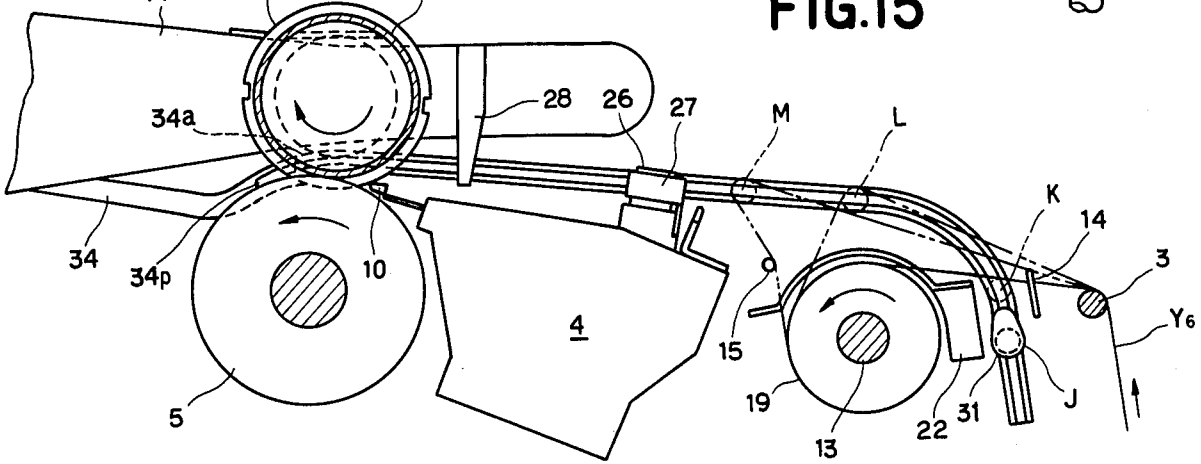
FIG. 15 is a side view of the yarn conveying mechanism shown in FIG. 14.
Figure 14:
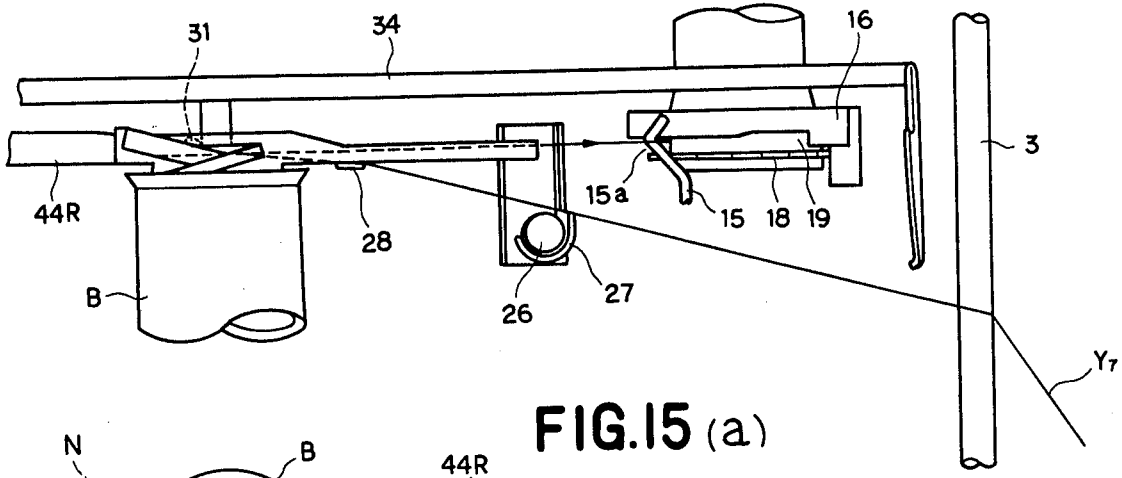
Figure 15:
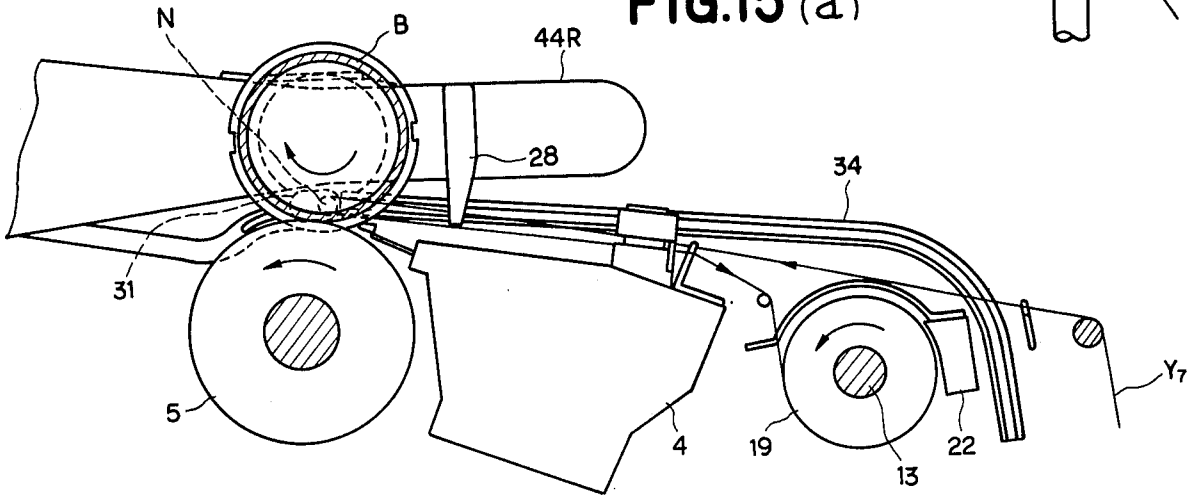
Figure 14:
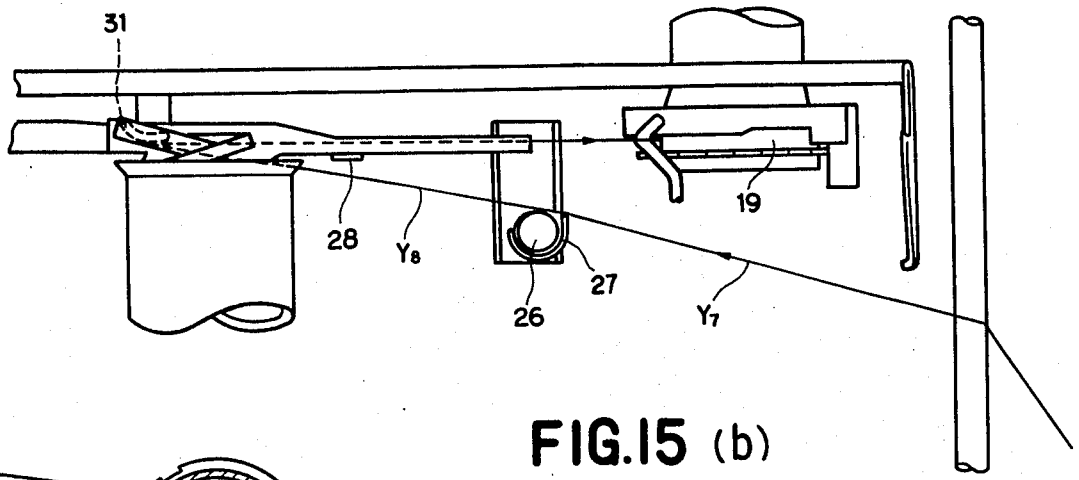
Figure 15:
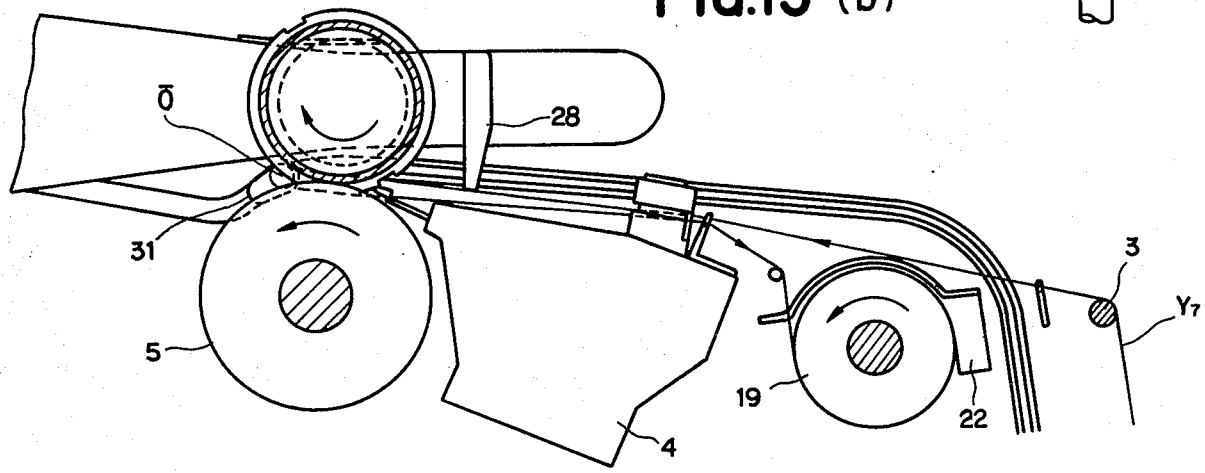
Figure 14:
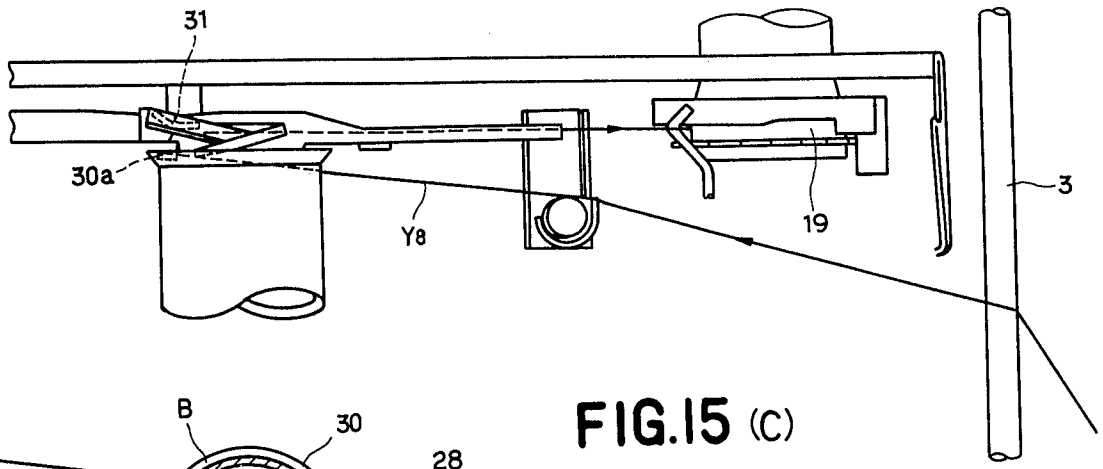
Figure 15:
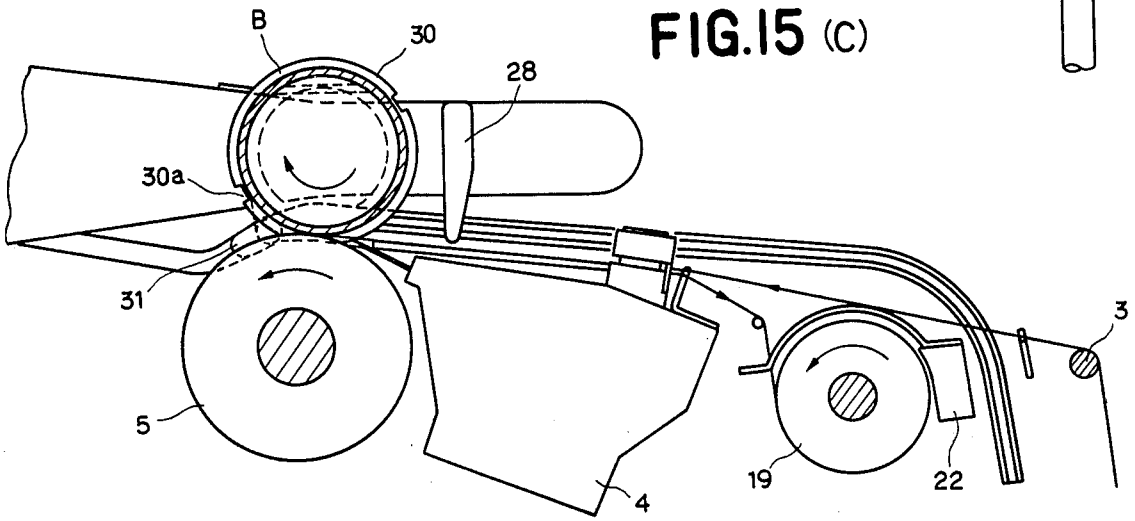
Figure 14:
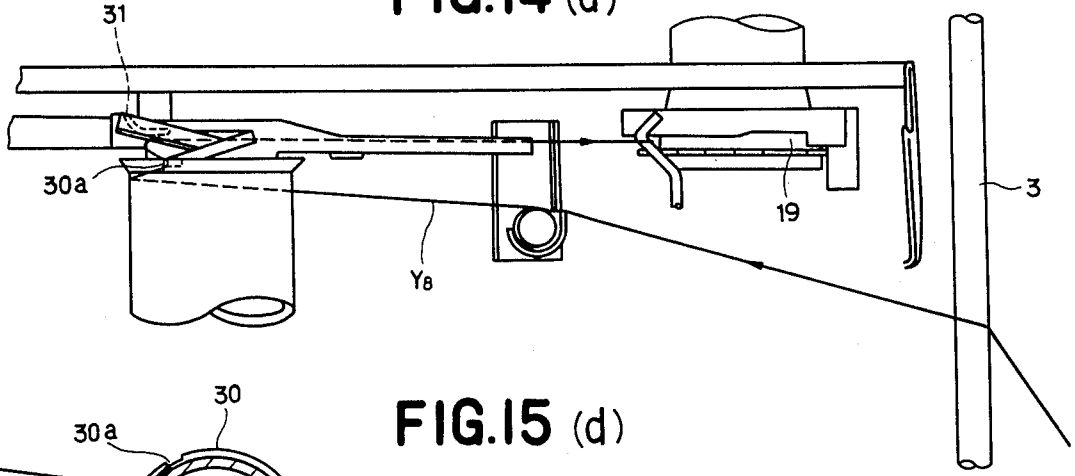
Figure 15:
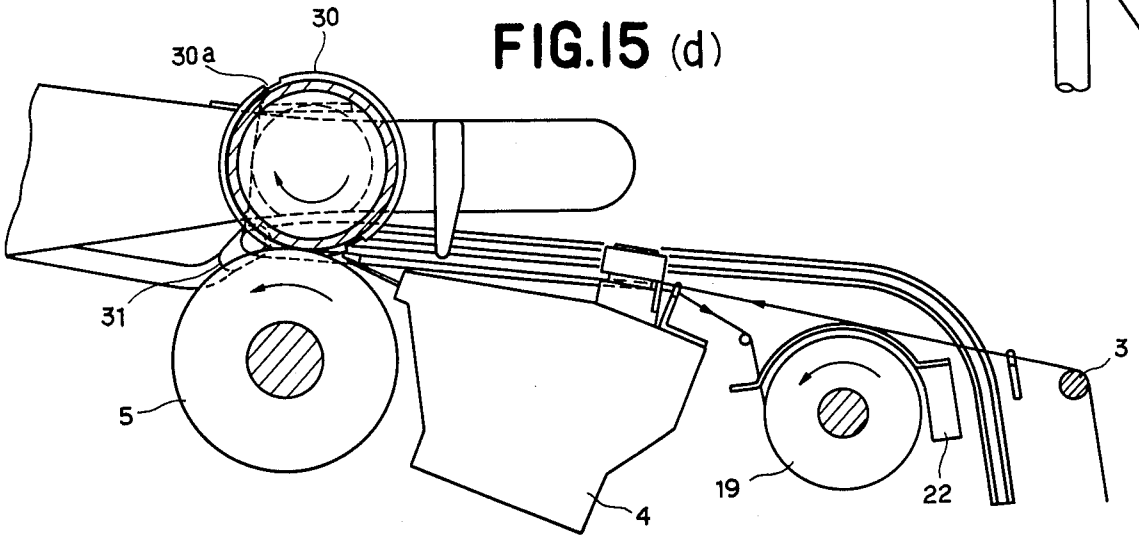
Figure 14:
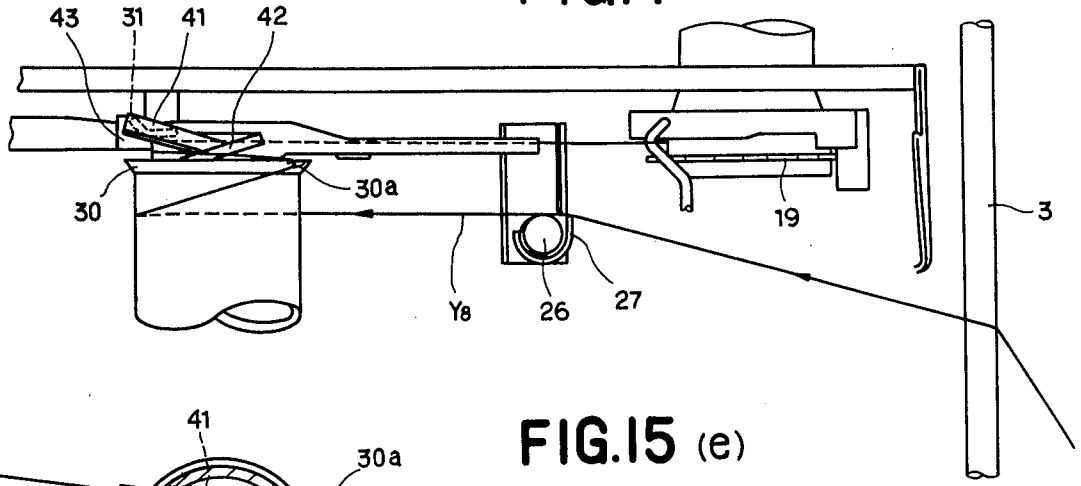
Figure 15:
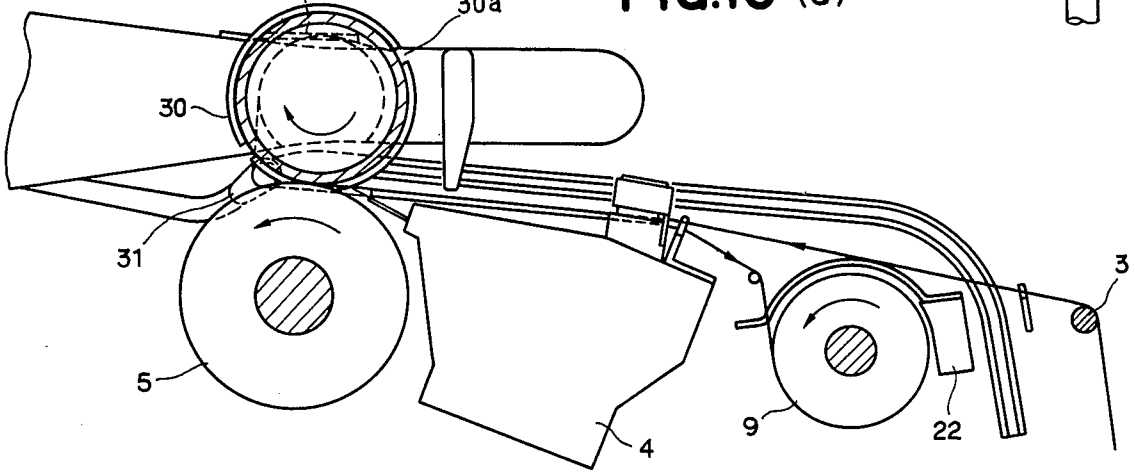
Figure 14:
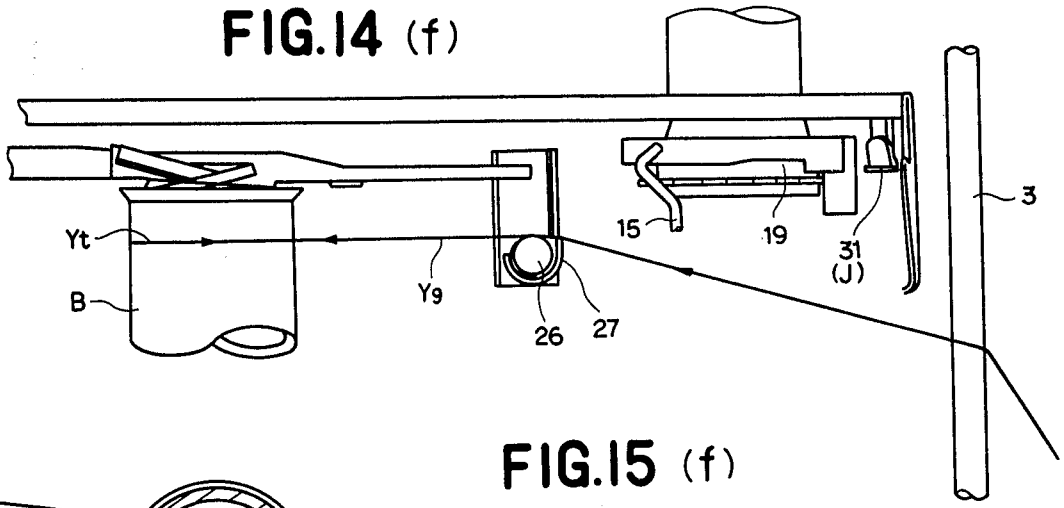
Figure 15:
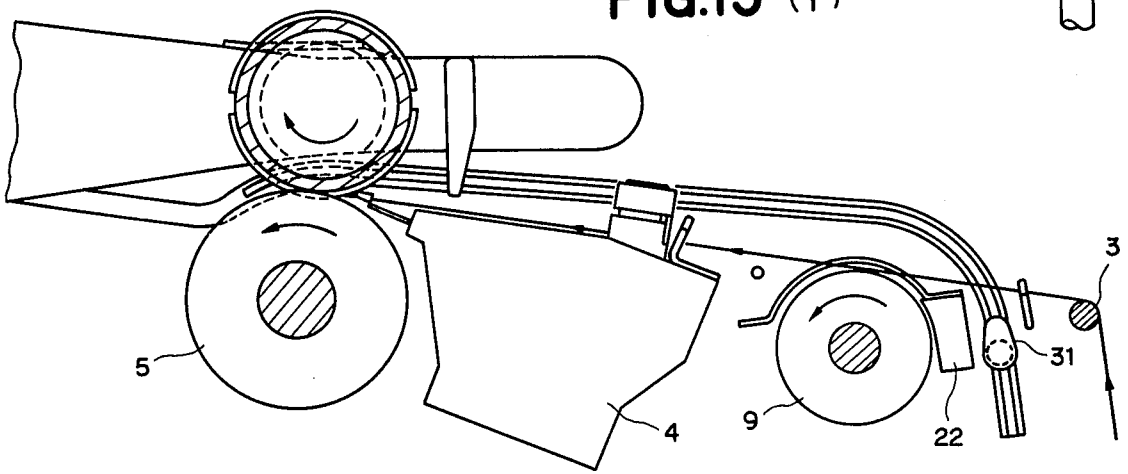

The guide member 31 then moves to a point $\overline{O}$ (FIG. 15(*b*)) along the downwardly curved portion of the pipe 34, whereupon the upstream portion of the yarn $Y_7$ which extends around the guide member 31 is released out of engagement with the distal end of the timing guide 28. The yarn which has travelled along the yarn path $Y_7$ is now fed along a rectilinear yarn path $Y_8$ between the guard 27 and the guide member 31 (See FIGS. 14(*b*) and 15(*b*)). The yarn path $Y_8$ thus defined be picked up by the notched wheel 30 on the flange of the bobbin bearing as it rotates. The yarn which has been picked up by the notched wheel 30 is wound around the empty bobbin B.

The yarn along the yarn path $Y_8$ would reliably be picked up by the notched wheel 30 upon the guide member 31 arriving at the point N even if there were no timing guide 28. However, such yarn picking from an incomplete yarn path would take a long period of time in which multifilament yarn would be likely to produce filament separation or to be severed, failing to get caught by the notched wheel 30. The timing guide 28 prevents such a difficulty since it allows the yarn to be fully picked up by the notched wheel 30 the instant the yarn is free from the timing guide 28.

The yarn is transferred from the guide member 31 onto the notched wheel 30 at a lower position of the latter such that the direction of travel of the yarn along the yarn path $Y_8$ agrees with the direction of rotation of the notched wheel 30. Such yarn catching below the notched wheel 30 prevents the yarn along the yarn path upstream of the notched wheel 30 from being loosened. However, the yarn tension should be as small as possible immediately before the yarn is caught by the notched wheel.

As mentioned above, the peripheral speed of the winding part 19 of the waste spool 202 is so selected as to wind the yarn therearound at a low speed while the yarn is being caught. Temporary reduction in the speed or stoppage of the guide member 31 causes the yarn portion upstream of the notched wheel 30 to be loosened or sagged by an amount which is proportional to the interval of time in which the guide member 31 is slowed down or stopped. By stopping the guide member 31 for a period of time ranging from 0.5 to 2 seconds, a yarn tension may be selected which is suitable upon yarn catching for any kind of yarn. The drive shaft 35 should preferably be controlled by a timer switch for temporary stoppage for a desired period of time.

One of the causes of yarn catching failures has been improper relative positional relationship between the notched wheel 30 and the guide member 31. With the notched wheel 30 and bearings 29L, 29R mounted on the cradle arms 44L, 44R which are freely openable and closable, the notched wheel 30 is rendered positionally unstable by improper engagement of empty bobbins B with the bobbin bearings 29L, 29R due primarily to irregular lengths of the empty bobbins and flattening of the end faces of the latter. The positionally unstable notched wheel 30 imposes an adverse effect on the chance of success of yarn catching. Other difficulties are that with the bobbin B mounted improperly on the cradle arms 44L, 44R and the rectangular pipe 34 out of position, the guide member 31 is apt to interfere with the notched wheel 30 and the cradle arm 44R, resulting in malfunctioning of the guide member 31 and a failure for the latter to return to its starting position.

The slider 38 and the positioning member 40 are provided to eliminate the above problems. As shown in FIGS. 17 and 18, the slider 38 is secured in position by the fasteners **39*b*, 39*c* to the curved pipe portion where the movement of the guide member 31 terminates. The slider 38 includes an end face extending toward the guide member 31 and on which the guide holder 32 is slidable, an arrangement which maintains the guide member 31 at proper level. The positioning member 40 is fixed to the slider 38 and held in abutment against both the lower and side faces of the cradle arm 44R coaxially, with the bobbin bearing to keep the notched wheel 30 spaced apart from the guide member 31 by an optimum clearance therebetween. The positioning member 40 thus allows the components to be positioned with respect to the cradle arm 44R, maintaining the notched wheel 30 and the guide member 31** at a constant mutual positional relationship even if bobbins B mounted have uneven lengths or installed incorrectly.

The yarn $Y_8$ as caught by the notched wheel 30 passes below the bobbin B while sandwiched between the bobbin B and the drive roller 5, and is wound halfway around the bobbin B from the rear thereof up to the upper point thereon as illustrated in FIGS. **14(*e*) and 14(*f*), whereupon the yarn is led by the guide 42 to the cutter 41 fixed to the cradle arm 44R. A portion of the yarn $Y_8$ caught by the notched wheel 30 downstream thereof is then cut off, and becomes wound around the waste spool 202. The upstream end of the yarn $Y_8$ is wound around the bobbin B through the notched wheel 30**.

More specifically, as illustrated in FIGS. **14(*c*) and 15(*c*), when the notched wheel 30 is turned through 90° with the yarn $Y_8$ caught thereby, the yarn $Y_8$ as it is received in the notch 30*a* slips toward the waste spool 202. When the notched wheel 30 is angularly moved through 180° from the position it has caught the yarn $Y_8$, the yarn $Y_8$ still slips toward the waste spool 202 and remains unsevered, as shown in FIGS. 14(*d*) and 15(*d*). As the notched wheel 30 is turned through 270° from the position it has picked up the yarn $Y_8$, as shown in FIGS. 14(*e*) and 15(*e*), the yarn extending from the notched wheel 30 to the waste spool 202 is guided toward the cutter 41 which severs the yarn. At this time, a portion of the yarn which extends between the notch 30*a* and the cutter 41** is folded to assure reliable yarn catching.

The cutter 41 severs the yarn $Y_8$ when the yarn $Y_8$ is pulled toward both the bobbin B and the waste spool 202 after the yarn has been caught by the notched wheel 30 and wound through a certain angle, and when the yarn $Y_8$ thus pulled is tensioned to such a degree that the yarn is forced into contact with the cutter 41.

The foregoing arrangement prevents the yarn to be subjected to an undue tension and allows yarn to be cut off at a constant position, advantages which result in a greater chance of success of yarn catching and prevent the yarn from being caught by the bobbin bearing 29R. These advantages manifest themselves when heavier denier yarn is handled.

Were it not for the cutter 41, the yarn Y as picked up by the notched wheel 30 would be pulled toward both the empty bobbin B and the waste spool 202, and, although the yarn Y after being wound around the bobbin B would not be subjected to a large tension, the yarn Y as wound around the waste spool 202 would be pulled by the notched wheel 30 and the waste spool 202 in opposite directions and be tensioned abruptly to the extent that the yarn would eventually be ruptured. Yarn which would be ruptured in this manner could be broken at varying points. Yarn breakages near the notched wheel 30 are attributable to failure to pick up yarn. With heavier denier yarn, rotation of the empty bobbin B would be brought to a halt, causing loosening of the yarn and failing to catch the yarn. The cutter 41 produces cut yarn ends of a constant length, and severs yarn under low tension, so that none of the foregoing problems are experienced and the yarn can be picked up by the bobbin B more successfully.

It is necessary that several convolutions of tail yarn be formed in addition to ordinary yarn convolutions around the bobbin B. As shown in FIGS. **14(*f*) and 15(*f*), to this end, the yarn is retained and guided by the guard 27 and the screw guide 26, respectively, so as to be wound around the bobbin B in a direction perpendicular to the axis of the bobbin B, thereby forming tail yarn coils. The yarn as it is retained by the guard 27 remains out of contact with the screw guide 26 until the yarn is wound around the bobbin B. When the yarn is wound around the bobbin B along a yarn path $Y_9$ extending normally to the axis of the bobbin B, the yarn is allowed to enter the groove in the outer periphery of the screw guide 26 through the guard 27. Rotation of the screw guide 26 at a predetermined speed causes the yarn $Y_9$ to be raised along the groove in the screw guide 26 until the yarn moves across and over the screw guide 26 and the guide 27** into a position wherein the yarn is wound into normal convolutions around the bobbin B.

The number of convolutions of tail yarn is determined by the speed of travel of the yarn Y and the interval of time in which the yarn is retained on the screw guide 26. The screw guide 26 is thus adjustable for its speed of rotation in view of the speed at which the yarn is wound around the bobbin B.

The guard 27 serves to protect the screw guide 26 when tail yarn convolutions are formed. The yarn is kept by the guard 27 out of contact with the screw guide 26 before the yarn $Y_8$ is wound around the bobbin B. When the yarn is fed along the yarn path $Y_9$ to form tail yarn coils on the bobbin B, the yarn is received in the groove in the screw guide 26. During the interval of time from the moment the yarn enters the screw groove to the moment the yarn is released of engagement with the screw guide 26, the yarn is continuously wound on itself around the bobbin B at the same position. Such tail yarn formation due to positive rotation of the screw guide 26 is best suited to high-speed yarn winding operation, and even tail yarn convolutions can be produced independently of the tension which the yarn undergoes.

The yarn $Y_9$ as it is released of the screw guide 26 has a tendency to be wound around the bobbin B perpendicularly thereto while being supplied from the guide 2. As the yarn is shifted toward the center on the bobbin B, the yarn is received in an automatic pickup groove in the traverse guide 10 to start normal yarn winding operation. After tha yarn has been transferred onto the bobbin B, the guide member 31 is cuased to return to the point J upon reverse rotation of the drive shaft 35, and the waste spool 202 and the screw guide 26 stop their rotation.

DOFFING STEP

The doffing step will be described with reference to FIGS. 19 through 23.

Figure 23:
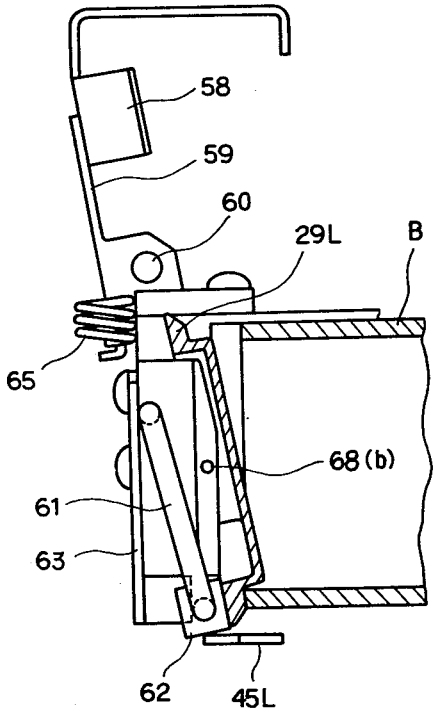

The cradle arms 44R, 44L are lifted by the arm 52 actuated by the actuator cylinder 55 to a doffing preparatory position G which is located outside the zone in which the cradle arms 44R, 44L are angularly movable under normal yarn winding conditions. When the cradle arms are in the doffing preparatory position G, the extension lever 47 attached to the cradle arm 44R has its free end held in abutment against the eccentric cam 48 at its high eccentric position. On lifting movement of the cradle arms 44R, 44L, the one-way lever 59 is brought into engagement with a slanted cam surface of the brake cam 58 secured to the front support column 91, whereupon the slanted cam surface causes the one-way lever 59 and the crank 61 to press the brake tip 62 axially against a flange of the bobbin bearing 29L (FIG. 23). The flange of the bobbin bearing 29L frictionally brakes the package P while the latter is rotating at high speeds.

Then, the flanged eccentric cam 48 is axially moved toward the center of the cradle, causing one of the flanges of the cam 48 to engage the lever 47 and angularly move the cradle arm 44R about the pin 46 in the opening direction. The bobbin bearing 29L and the intermediate bearing 66 are pressed by the brake tip 62 to turn about the shafts **68*a*, 68*b* for being inclined upwardly with respect to the axis of the bobbin B. At this time, the bobbin B is released of fitting engagement with the bobbin bearing 29L, and the bobbin B and hence the package P are axially pushed out by a distance corresponding to the axial length of a portion of the bobbin bearing 29L which has fitted in the bobbin B. The package P thus released is shifted onto the bobbin support rail 45L** due to gravity.

When the cradle arm 45R swings about the pin 46, the bobbin bearing 29R becomes inclined with respect to the axis of the bobbin B, which is then released of the bobbin bearing 29R and moved in the axial direction. The full package P as thus disengaged from both the bobbin bearings 29R, 29L is received by the bobbin support rails 45R, 45L and then neatly adjusted in attitude thereof of its own accord.

The springs 92 (FIG. 24) are disposed closely to the ends of the bobbin B of the package P when the parts are in the doffing preparatory position G, to thereby prevent the bobbin B from being raised and assist it in disengaging when the cradle arm 44R is opened. The bobbin B is likely to be raised when the bobbin bearings are tightly fitted in the bobbin B and the package P is as small and light as the empty bobbin is. The higher the speed of rotation of the full package P, the harder it is to brake the package P and hence the longer the time it takes to brake the package P. When the cradle arm 44R is opened while the spindle is not being braked, the package P is prone to be discharged out toward the yarn supply side under the inertia that remains acting on the package P. The springs 92 prevent such defects and serve to adjust the package properly in position.

As the flanged eccentric cam 48 is turned through about 180 degrees from a high to a low eccentric position, the cradle arms 44R, 44L are pivotally moved to the donning position H by the actuator cylinder 55 actuated for the remaining stroke. While the cradle arms 44R, 44L are displaced from the doffing position G to the donning position H in a relatively short period of time, the bobbin support rails 45R, 45L which support the ends of the bobbin B carrying the package P are joined to the reserve rails 70R, 70L, whereupon the package P starts automatically due to gravity to roll down the reserve rails toward the rear of the yarn take-up machine 201. The doffing step is thus completed.

During the doffing step, when the cradle arms 44R, 44L are lifted to the fully wound position F, the one-way lever 59 engages the brake cam 58 secured to the front support column 91, whereupon the bobbin B is automatically braked. Then, the cradle arms 44R, 44L are caused to ascend to the doffing position G, in which the cradle arm 44R is opened. At this time, the bobbin bearing 29L is tilted by the brake tip 62 to push the bobbin B axially toward the cradle arm 44R for easy doffing operation with the cradle being half-opened. In the doffing position G, the springs 92 are located closely to the bobbin B to prevent the latter from becoming inclined as it is disengaged from the bobbin bearings 29R, 29L and at the same time to prevent the package P from being jumped out. The package P is temporarily placed on the bobbin support rails 45R, 45L in the doffing position G for attitude adjustment, and then is raised to the donning position H in which the package P is transferred onto the reserve rails 70R, 70L. With this arrangement, the package P is prevented from dropping off accidentally.

DONNING STEP

The donning step will be described with reference to FIG. 24. When the drive shaft 71 is angularly moved counterclockwise, the feed arms 75 are turned counterclockwise against the bias of the counterbalance spring 79 to enable the bobbin support 77 with an empty bobbin $B_1$ thereon to approach along an arching path the bobbin bearings 29R, 29L on the cradle arms 44R, 44L. At this time, the bobbin separator 83 is disengaged from the cam 94 mounted on the feed arms 75 adjacent to the bobbin support upon angular movement of the feed arms 75, and the bobbin separator 83 is caused by gravity to turn counterclockwise about the shaft 84 to prevent a following bobbin $B_2$ from being pushed out of the reserve rails. At this time, the cradle arms 44R, 44L are in the donning position H with the bobbin bearings 29R, 29L being spread apart.

The feed arms 75 continuously swings counterclockwise until the bobbin support 77 abuts against the bobbin support rails 45R, 45L fixed to the cradle arms 44R, 44L, whereupon the bobbin $B_1$ is axially aligned with the bobbin bearings 29R, 29L to a nicety. Then, the shaft 49 on which the eccentric cam 48 is mounted is axially moved to return from the center of the cradle. The cradle arm 44R is now angularly moved clockwise (as shown in FIG. 19) about the pin 46 into the closed position under the force from a spring (not shown) in the cradle arm 44R. The bobbin $B_1$ is axially moved toward the bobbin bearing 29L so as to fit therein, so that the bobbin $B_1$ is installed in position.

The cylinder 55 (FIG. 20) is actuated in the opposite direction to lower the cradle arms 44R, 44L into contact with the drive roller 5 in the winding start position E. As the cradle arms 44R, 44L are moved downwardly with the bobbin $B_1$ carried thereon, the bobbin support on the feed arms 75 which stay in the bobbing supplying position is angularly moved counterclockwise about the pins 76 against the force from the return spring 78 to allow the bobbin $B_1$ to be transferred from the bobbin support 77 onto the cradle arms. At this time, the bobbin $B_1$ rolls from the bobbin support 77 into correct axial alignment with the bobbin bearings 29R, 29L. Thereafter, the bobbin support 77 returns to its normal position under the bias of the return spring 78. The feed arms 75 are swung clockwise under the resiliency of the counterbalance spring 79 and by rotation of the drive shaft 71.

On returning movement of the feed arms 75, the cam 94 thereon is brought into engagement with the bobbin separator 83 to lift the latter clear of engagement with the next bobbin $B_2$ carried on the storing rails 82. The bobbin $B_2$ is caused by gravity to roll down the inclined storing rails 82 onto the bobbin support 77, and a following bobbin $B_3$ is also advanced to a position next to the bobbin $B_2$ as placed on the bobbin support 77.

When the former doffing step fails and the package P remains on the cradle arms 44R, 44L or the cradle arm 44R is not open, thus resulting in premature conditions preparatory for the donning step, the machine is protected against damages by a safety mechanism even if the drive shaft 71 is actuated for the bobbing supplying operation. More specifically, when the feed arms 75 are subjected at their distal ends to undue loads, they are allowed to be bent about the pins 73. Where a number of spindles are driven at the same time by a common shaft, the foregoing safety mechanism is actuated only for those spindles which failed to be supplied, thus localizing troubles.

When donning for the bobbin $B_1$ is unsuccessful, the feed arms 75 are returned toward the storing rails 82 with the bobbin $B_1$ carried on the bobbin support 77. At this time, the bobbin separation arm 83 is lifted by the cam 94, and the bobbin $B_1$ is allowed to remain on the bobbin support 77 without disturbing the bobbins $B_2$, $B_3$ on the storing rails 82. Thus, the feed arms 75 can be returned to their starting position smoothly.

The counterbalance spring 79 normally urges the feed arms 75 in a direction to offset the tendency for the feed arms 75 to turn due to gravity. With this construction, a number of spindles can be driven by a common shaft with a reduced amount of driving force, and irregularities among the spindles due to twisting of the drive shaft can be reduced.

When the drive shaft 71 is disconnected from the power source while the feed arms 75 are in the returned position, the feed arms 75 fall forward due to gravity. If yarn were wound continuously with the feed arms 75 thus lowered, the outer periphery of the package P as it is substantially fully wound would interfere with the bobbin support 77, and the package yarn quality might be deteriorated. To cope with this problem, the counterbalance spring 79 is selected in strength and length so that the feed arms 75 will be prevented from fall down when the driving force for the drive shaft 71 is lessened, and irregularities among the spindles due to a reduction in the driving force and twisting of the drive shaft 71.

The components of the yarn take-up machine will be actuated in accordance with a sequence of operations shown in FIG. 25.

In practice, the doffing step is composed of operations which are selected from the following three processes with respect to the yarn take-up machine:

(1) High-speed continuous operation with fully automatic doffing: The steps of yarn transferring, doffing, donning, and yarn conveying are effected fully automatically while the yarn take-up machine is operated at high speeds as indicated by the sequence A. This mode of operation is aimed at increased availability of the yarn take-up machine.

(2) Temporary machine slow down with fully automatic doffing: After the yarn shifting step has been effected, the take-up machine is slowed down stopped as indicated by the sequence B, during which time doffing and donning are carried out. Then, just before the yarn catching step is started, the yarn take-up machine is operated at high speeds, and then the yarn catching is carried out. Waste can be reduced by this mode of operation.

(3) Temporary machine de-energization with semiautomatic doffing: The yarn take-up machine is slowed down or stopped as shown in the sequence B, and the process is composed of four steps of yarn transferring, doffing, donning, and yarn conveying. Automatic operation is effected in each of the steps, but shifting from one step to another is done by actuating a push-button or switch for commanding step proceeding. This mode of operation enables visual confirmation of the completion of each step, and is advantageous in that positions which have failed in each step can be restored for another operation in the step, the final chance of success, i.e., the ratio of operating time of the machine to downtime thereof can be increased, and waste can be reduced.

The sequence of operations of the cylinder 55 will be additionally described. The operation sequence of the cylinder 55 corresponds to that of the cradle. The cylinder 55 remains inoperative on its rod and piston sides and is vented to atmosphere immediately before the doffing step starts. Upon command for the doffing operation, the cylinder 55 is pressurized on its piston side to raise the cradle arms 44R, 44L up to the doffing position G, in which the bobbin is braked. Rotation of the flanged eccentric cam 48 causes the cradle arms 44R, 44L to be lifted to the donning position H, in which the package P is donned. Then, an empty bobbin B is supplied from the feed arms 75 onto the cradle arms 44R, 44L, whereupon the cradle arm 44L is closed to install the bobbin B in position. The cylinder 55 is pressurized on its rod side to lower the cradle arms 44R, 44L. When it is confirmed that the cradle arms 44R, 44L for all spindles are moved down, or under empirical time control, the rod side of the cylinder 55 is relieved of pressurization to complete the donning step. Upon completion of the donning step, the cradle arms 44R, 44L can be moved manually up and down, so that restoration during semi-automatic operation can be performed with ease. Simultaneously with starting of the yarn catching step, the cylinder 55 is pressurized on its rod side again to lower the cradle arms 44R, 44L, thereby pressing the bobbin B as installed against the drive roller 5 under a force proportional to the pressurization of the cylinder 55. Actuation of the cylinder 55 to press the bobbin B against the drive roller 5 under an initial pressure prevents the operator from forgetting to lower the cradle arms 44R, 44L, from lowering the cradle arms short of the desired position, and also prevents the bobbin B from being insufficiently rotated due to a lack of required initial pressure, resulting in an increased chance of success of yarn catching operation.

Application of the initial pressure against the bobbin may be varied under time control. At an initial stage of yarn winding operation, the cylinder may be vented to atmosphere at its both ports to remove the initial pressure, and the pressure at which the bobbin B is held against the drive roller 5 may be given by a pressure mechanism separately disposed for producing a pressure which varies with the diameter of wound yarn.

The yarn take-up machine resides in that the doffing and donning steps, and associated yarn transferring and yarn conveying steps can be carried out easily and reliably with a relatively small number of machine components. Control of the yarn take-up machine may be modified such that the doffing and donning steps will be performed manually to retain an desired degree of product quality and to confirm bobbin installation, and the yarn transferring and conveying steps will be automatically effected. More specifically, up and down movement, and opening and closing actuation of the cradle arms 44R, 44L, and bobbin supplying operation with the feed arms 75 may partly or wholly be effected by manual forces and the waste spool 202, the slide bar 3, the guide member 31, and the screw guide 26 may be automatically actuated for yarn switching operation.

With the yarn take-up machine, operation errors in each of the yarn transferring step, the doffing step, the donning step and the yarn conveying step can greatly be reduced. Thus, the efficiency of the machine is increased, and the machine can be operated at high speeds. Waste can be reduced since the above steps can be carried out reliably and smoothly within a short period of time.

Figure 26:
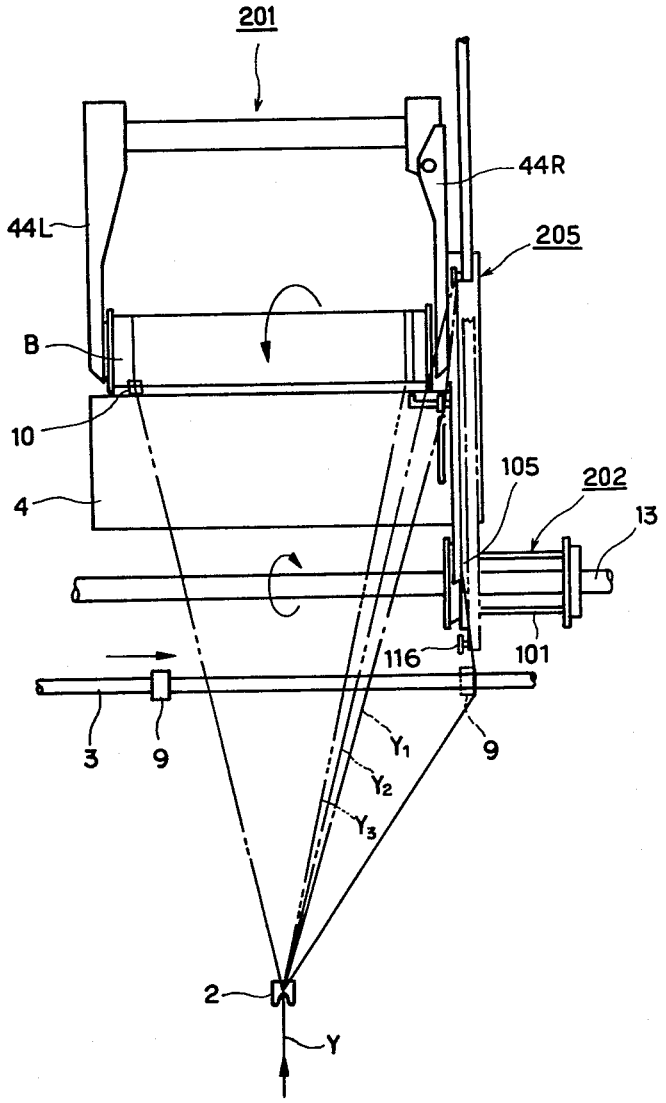
FIG. 26 is a plan view of a yarn conveying mechanism according to a second embodiment.

A yarn conveying mechanism according to another embodiment will be described with reference to FIGS. 26 and 27.

A yarn conveying mechanism 205 is disposed between a yarn take-up machine 201 and a waste spool 202. A flat body 112 having a bent yarn guide path 111 is mounted on a machine base 7 and extends from a position rearward of the waste spool 202 toward a position alongside of an empty bobbin B as installed in position. A runner 115 engages in the yarn guide path 111 and comprises a roller rotatably mounted on a distal end of a lever 114 swingably mounted on a yarn guide support 113. The yarn guide support 113 is in the form of a rod having a curved end on which a yarn guide 116 is mounted. The yarn guide support 113 has on its opposite end a rack 119 with which there is held in meshing engagement with a pinion 118 fixed to a drive shaft 117 that constitutes part of a mechanism for driving the yarn guide 116. The yarn guide support 113 is normally urged against the pinion 118 by a presser plate 120 secured to the machine base 7, so that the yarn guide support 113 will be prevented from popping up when it is actuated.

Operation for enabling yarn Y as wound on the waste spool 202 to be wound around an empty bobbin mounted on and driven by the yarn take-up machine 201 will be described with reference to FIGS. 26 and 27.

The yarn guide 116 is initially disposed below yarn as it runs from a thread transfer collar 9 to the waste spool 202 as illustrated by the two-dot-and-dash lines in FIGS. 26, 27. When the drive shaft 117 is rotated clockwise in the direction of the arrow R in FIG. 27 with yarn Y being wound around the waste spool 202, the yarn guide support 113 is moved to the right by the rack 119 which is in mesh with the gear 118. With the lever 114 and the yarn guide support 113 being pivotably coupled to each other by a pin 121, the lever 114 is angularly moved about the pin 121 while the distal end of the lever 114 is located at the front end of the yarn guide path 111. The yarn guide 116 now moves along a path defined by points a, b, c, and d. When the yarn guide 116 reaches the position d, the lever 114 is held against a stop 121' and prevented from being turned, and at the same time is caused to move along the yarn guide path 111. The yarn guide 116 further moves along successive points e, f, g. On movement of the yarn guide 116 from the position a to the position c, the yarn Y is disengaged from the thread transfer collar 9 and has an upstream portion extending from the guide 2 to the yarn guide 116. The portion of the yarn Y which is downstream of the yarn guide 116 is wound around the waste spool 202 via a fixed guide 105 (FIG. 26) disposed adjacent to the waste spool 202. As shown in FIG. 26, the portion of the yarn Y which is upstream of the yarn guide 116 extends along a yarn path that is displaced to the left from $Y_1$ to $Y_2$ to $Y_3$ as the yarn guide 116 moves on. When the yarn guide 116 is in the position h, the portion of the yarn Y that is upstream of the yarn guide 116 is fed along the yarn path $Y_3$, and is picked up by a notched wheel 30 in a bobbin bearing 29R so as to be wound around the periphery of the empty bobbin B. The yarn as it is wound around the empty bobbin B is transferred to the center of the bobbin, and is caught by a traverse guide 10 driven by a traversing mechanism 4. The yarn Y is now traversed axially of the bobbin B for forming yarn layers of convolutions on the bobbin B which are eventually shaped into a package. The portion of the yarn Y that is downstream of the yarn guide 116 is continuously wound on the waste spool 202, while at the same time the yarn portion is pulled by the notched wheel 30 in the bobbin bearing 29R. The yarn portion is severed between the notched wheel 30 and the waste spool 202, whereupon a yarn end is attached to the waste spool 202. Thus, the yarn shifting from the waste spool 202 to the bobbin B is completed. Upon completion of the yarn shifting, the yarn guide 116 is moved to the position i, and the drive shaft 117 stops its rotation. The yarn guide 116 is held at rest in this position, but will be returned to the starting position by the gear 118 before a next yarn transferring operation starts.

Figure 27:
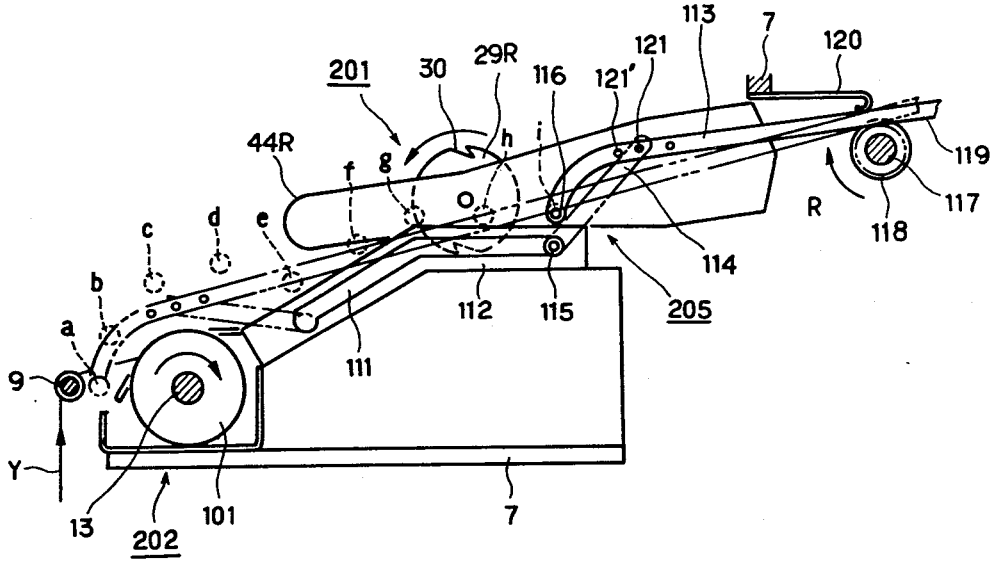
FIG. 27 is a side view of the yarn conveying mechanism shown in FIG. 26.
Figure 28:
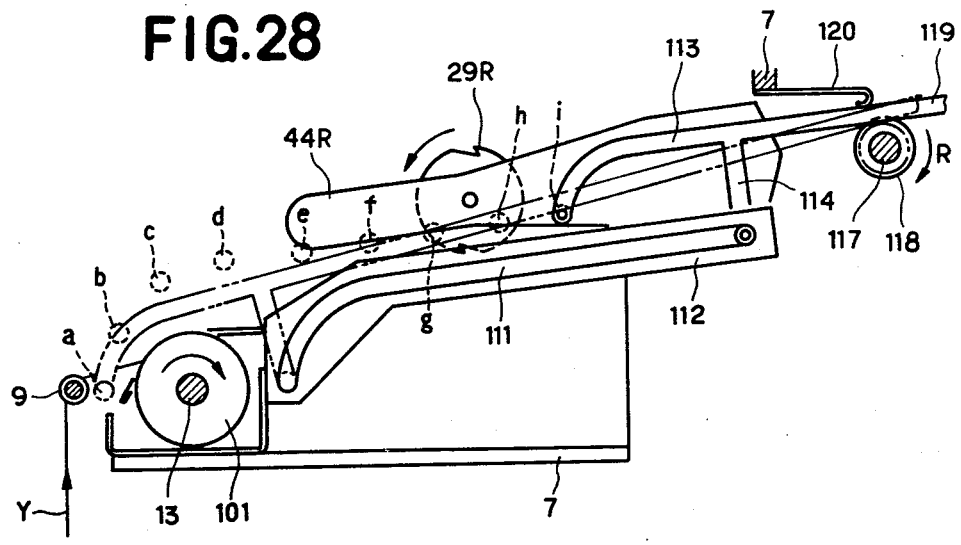
FIG. 28 is a side view of a yarn conveying mechanism according to a third embodiment.

FIG. 28 shows a modified yarn conveying mechanism according to a third embodiment. The yarn conveying mechanism shown in FIG. 28 differs from that of FIGS. 26, 27 in that a lever 114 is fixed to a yarn guide support 113. With the fixed lever 114, it is necessary that a yarn guide path 111 should be longer than that shown in FIG. 27, but the overall structure is relatively simple. The other arrangements shown in FIG. 28 are the same as those of FIGS. 26 and 27.

Figure 30:
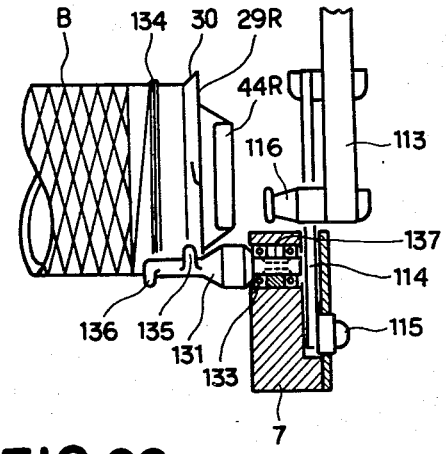
FIG. 30 is a cross sectional taken along line XXX—XXX of FIG. 29.
Figure 29:
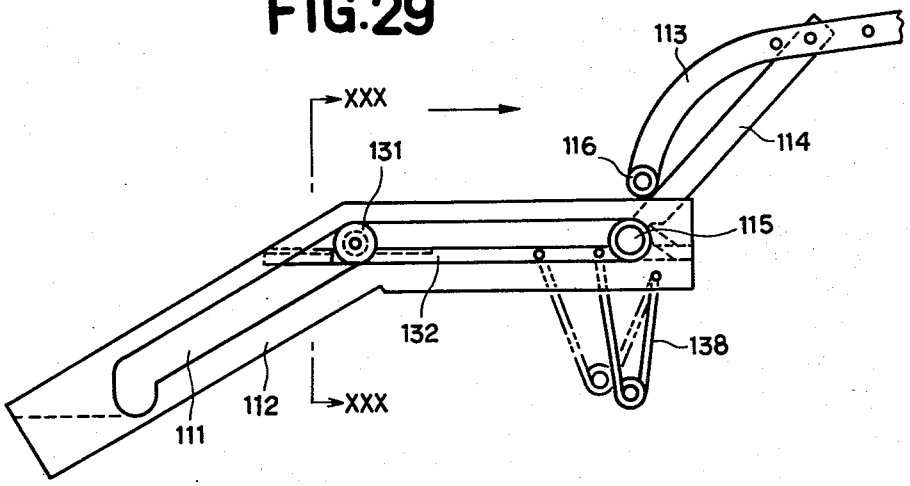
FIG. 29 is a side view of a tail catching guide which is interlinked with a yarn conveying guide.

FIGS. 29 and 30 show a yarn tail catching guide. As illustrated in FIG. 30, a yarn tail catching guide 131 is rotatably mounted on the machine base 7 and lies on a yarn path along which yarn is carried by the yarn guide 116. A rack 132 is disposed on a path of movement of the runner 115 and is in mesh with a gear 137 fixed to the yarn tail catching guide 131 which is mounted by a bearing 133 on the machine base 7. The rack 132 is normally biased to the left (as shown in FIG. 29) by a spring 138. When the yarn guide 116 reaches the position h (FIG. 27), the runner 115 engages the rack 132 and moves it to the right. As the rack 132 is moved, the yarn tail catching guide 131 is rotated to shift the yarn to a bunching position 134 on the bobbin B near its end in which the yarn is to be wound as bunched. Further rotation of the yarn tail catching guide 131, the yarn is disengaged from the guide 131 and displaced toward the axial center of the bobbin B, whereupon the yarn is picked up by the traverse guide for normal winding operation. The yarn tail catching guide 131 has two projections 135, 136 (FIG. 30) that protrude in different directions or at different angles. The yarn initially passes on the righthand side of the projection 135 and is wound around the bobbin B. When the yarn guide 131 rotates, the yarn is conveyed into a position between the projections 135, 136 to fix the yarn end to the end of the bobbin B at the position 134 where the yarn is to be bunched while being wound. As the guide 131 rotates further, the yarn is released of the guide 131.

Figure 31A:
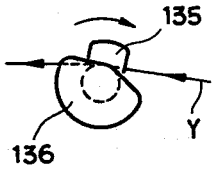
FIGS. 31(*a*) through 31(*c*) are views illustrative of progressive operations of the tail catching guide.
Figure 31B:
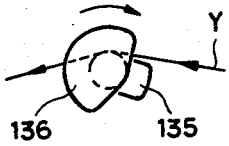
Figure 31C:
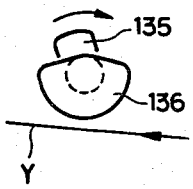

FIG. 31(*a*) shows the relation between the yarn and the yarn guide in which the yarn is just about to be picked up by the notched wheel 30 (FIG. 27). In FIG. 31(*b*), the parts are positioned when the yarn is shifted to the bunching position 134 after the yarn is caught. The yarn is shown in FIG. 31(*c*) as being disengaged from the yarn guide 131. The yarn tail catching guide enables tail yarn to be picked up simultaneously with catching of yarn.

The yarn winding apparatus of the present invention can wind yarn around a rotative drum at a substantially constant speed without reducing a rotational speed of the drum as time being. The yarn winding apparatus can be used as a drive means for feeding yarn at a substantially constant speed.

Although certain preferred embodiments have been shown and described in detail, it should be understood that many changes and modifications may be made therein without departing from the scope of the appended claims.

What is claimed is:

1. An apparatus for winding continuously supplied yarn at a substantially constant speed, comprising:

(a) a rotating drum having a winding part rotatable at a predetermined peripheral speed for winding the yarn around a peripheral surface thereof, a transferring part for successively transferring the yarn wound around said winding part, and a storage part for storing the yarn fed by said transferring part, said winding, transferring and storage parts being disposed adjacent to one another in the order named;

(b) a toothed wheel to catch the continuously supplied yarn around said rotating drum;

(c) a yarn guide for guiding the continuously supplied yarn onto said winding part of said rotating drum, (i) said toothed wheel being mounted coaxially with said rotating drum on an end of the latter which is remote from said storage part of said rotating drum; and (ii) said yarn guide being positioned upstream of said rotating drum with respect to the direction of supply of the yarn; and (d) a yarn take-up assembly disposed with respect to said toothed wheel and including:

(i) a bobbin supporting mechanism for rotatably supporting a bobbin;

(ii) a bobbin driving mechanism for driving the bobbin; and (iii) a yarn traversing mechanism for traversing the yarn axially of the bobbin to wind the yarn around the bobbin and form yarn layers thereon, said bobbin driving mechanism having an axis of rotation of the bobbin which extends substantially parallel to the axis of rotation of said rotating drum; and said yarn guide being movable across a zone in which the yarn is being traversed by said yarn traversing mechanism.

2. An apparatus according to claim 1, said winding part comprising a drum having a constant diameter and an eliminator fixedly disposed in confronting relation to a peripheral surface of said drum with a slight clearance therebetween.

3. An apparatus according to claim 1, said transferring part comprising a conical drum having a diameter which becomes progressively smaller in a direction away from said winding part.

4. An apparatus according to claim 1, said winding part comprising a conical drum having a diameter which is larger at an end thereof adjacent to said toothed wheel than at the other end of the conical drum.

5. An apparatus according to claim 1, said storage part comprising a plurality of rods extending parallel to the axis of said rotating drum in surrounding relation to said drum axis, said rods being movable radially of said rotating drum.

6. An apparatus according to claim 1, said bobbin supporting mechanism comprising a pair of cradle arms extending parallel to each other and having on distal end portions thereof bearings, respectively, for supporting ends of the bobbin, said bobbin driving mechanism comprising a frictionally rotatable drum for being held against the peripheral surface of the bobbin.

7. An apparatus according to claim 1, including a thread transfer guide disposed upstream of said rotating drum with respect to the direction of supply of the yarn, and a yarn catching guide reciprocably movable between said thread transfer guide and said bobbin supporting mechanism along a curved guide path by a guide support drivable by a source of drive.

8. An apparatus according to claim 7, said curved guide path comprising a channel body having an open side, said guide support comprising a flexible member movably fitted in said channel body.

9. An apparatus according to claim 7, including a machine base, said guide path comprising a cam in the form of a slot fixed to said machine base, said guide support having a cam follower held in engagement with said cam.

10. An apparatus according to claim 9, said guide support including a swingable lever on which said cam follower is mounted.

11. An apparatus according to claim 6, one of said bearings being movable substantially in the axial direction of the bobbin, the other bearing being supported through an intermediate bearing on the associated cradle arm, said intermediate bearing being supported for swinging movement about an axis normal to the axis of the bobbin.

12. An apparatus according to claim 11, said cradle arms being angularly movable between a position in which yarn starts being wound around an empty bobbin mounted on said cradle arms and a doffing position in which the bobbin on which the yarn is fully wound is doffed, including a mechanism having a contact member for acting on said bearing supported by said intermediate bearing when said cradle arms reach a doffing preparatory position.

13. An apparatus according to claim 12, said cradle arms having bobbin support rails disposed below said bearings, including full package reserve rails positioned in confronting relation to said bobbin support rails when said cradle arms are in the doffing position, said full package reserve rails being inclined such that ends thereof which confront said bobbin support rails are higher in level than the other ends.

14. An apparatus according to claim 6, including a pair of empty bobbin supply arms and an empty bobbin supply device for supplying empty bobbins to said pair of cradle arms, said empty bobbin supply arms being mounted for angular movement by a one-way driving member between said cradle arms and said empty bobbin supply device, said empty bobbin supply arms having on distal ends thereof a swingable bobbin support.

15. An apparatus according to claim 14, said one-way driving member being coupled to a counterbalance spring.

16. An apparatus according to claim 14, said empty bobbin supply device having a liftable bobbin separator at a position confronting said bobbin support.

17. An apparatus according to claim 7, including a timing guide disposed between said bobbin supporting mechanism and said rotative drum for defining a yarn path for the yarn supplied when the yarn catching guide is moved.

18. An apparatus according to claim 17, said yarn releasing mechanism comprising the timing guide fixed to one of said cradle arms, and the guide path curved downwardly rearward of said bobbin supporting mechanism.

19. An apparatus according to claim 18, said yarn releasing mechanism comprising the timing guide having rotatable projections disposed adjacent to said guide path, the guide support movable along said guide path, and a transmission mechanism interposed between said timing guide and said guide support.

20. An apparatus according to claim 6, including a movable thread handler guide disposed upstream of said rotating drum with respect to the direction of supply of the yarn, and a yarn catching guide reciprocably movable between said thread transfer guide and said bobbin supporting mechanism along a curved guide path by a guide support drivable by a source of drive.

21. An apparatus according to claim 20, including a machine base, said guide path comprising a cam in the form of a curved slot fixed to said machine base, said guide support having a cam follower held in engagement with said cam.

22. An apparatus according to claim 21, including a timing guide disposed between said bobbin supporting mechanism and said rotating drum for defining a yarn path for the yarn supplied when the yarn catching guide is moved, and a yarn releasing mechanism responsive to movement of said yarn catching guide for releasing the supplied yarn from said timing guide.

23. An apparatus according to claim 21, said yarn releasing mechanism comprising the rotating guide disposed adjacent to said guide path, the guide support movable along said guide path, and a transmission mechanism interposed between said timing guide and said guide support.

* * * * *